US011607858B2

(12) United States Patent
Graham et al.

(10) Patent No.: US 11,607,858 B2
(45) Date of Patent: Mar. 21, 2023

(54) METHODS AND MACHINE FOR FORMING A SHIPPING CONTAINER WITH AN ARTICLE RETAINING WEB

(71) Applicant: WestRock Shared Services, LLC, Atlanta, GA (US)

(72) Inventors: Thomas Dean Graham, Winter Garden, FL (US); Amer Aganovic, Orlando, FL (US); Claudio D'Alesio, Windermere, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/228,187

(22) Filed: Apr. 12, 2021

(65) Prior Publication Data

US 2021/0229390 A1 Jul. 29, 2021

Related U.S. Application Data

(63) Continuation of application No. 15/757,794, filed as application No. PCT/US2016/051502 on Sep. 13,
(Continued)

(51) Int. Cl.
*B31B 50/00* (2017.01)
*B31B 50/10* (2017.01)
(Continued)

(52) U.S. Cl.
CPC ..... *B31B 50/00* (2017.08); *B31B 50/10* (2017.08); *B31B 50/62* (2017.08); *B65D 5/606* (2013.01);
(Continued)

(58) Field of Classification Search
CPC ..... B31B 50/00; B31B 50/62; B31B 50/10; B31B 50/06; B31B 50/04; B31B 50/12;
(Continued)

(56) References Cited

U.S. PATENT DOCUMENTS 2,111,157 A * 3/1938 Stokes ..... B31B 50/72 493/110
2,284,604 A 5/1942 Brooks
(Continued)

FOREIGN PATENT DOCUMENTS

DE 9207356 U1 8/1992
EP 0323354 A1 7/1989
(Continued)

OTHER PUBLICATIONS

Mekatronik Gruppe; https://mekatronikgruppe6.files.wordpress.com/2014/04/t-bot.png.
(Continued)

*Primary Examiner* — Dariush Seif
(74) *Attorney, Agent, or Firm* — Rohini K. Garg

(57) ABSTRACT

A method for forming a container using a machine includes extracting a blank from a magazine, transferring the blank in a blank transfer direction X, and positioning the blank on a deck. The method also includes translating a pick-up assembly from a first end to a second end along a horizontal direction Y perpendicular to the blank transfer direction X, the translating including transferring a web from a first location proximate the first end to a second location proximate the second end. The method further includes depositing, at the second location, the web into an at least partially overlying relationship with the blank to form a blank assembly, transferring the blank assembly along the deck in the blank transfer direction X while translating the pick-up assembly from the second end back to the first end, and wrapping the blank assembly around a mandrel to at least partially form the container.

18 Claims, 13 Drawing Sheets

Related U.S. Application Data

2016, now Pat. No. 11,001,026, which is a continuation of application No. 14/860,457, filed on Sep. 21, 2015, now Pat. No. 10,987,889.

(51) Int. Cl.

| | |
|---|---|
| ***B31B 50/62*** | (2017.01) |
| ***B65D 5/60*** | (2006.01) |
| ***B31B 50/04*** | (2017.01) |
| ***B31B 50/06*** | (2017.01) |
| ***B31B 50/28*** | (2017.01) |
| ***B31B 120/30*** | (2017.01) |
| ***B31B 120/40*** | (2017.01) |
| ***B31B 105/00*** | (2017.01) |
| ***B31B 50/12*** | (2017.01) |
| ***B31B 110/35*** | (2017.01) |

(52) U.S. Cl.

CPC ..... *B31B 50/04* (2017.08); *B31B 50/06* (2017.08); *B31B 50/12* (2017.08); *B31B 50/28* (2017.08); *B31B 2105/00* (2017.08); *B31B 2105/0022* (2017.08); *B31B 2110/35* (2017.08); *B31B 2120/30* (2017.08); *B31B 2120/40* (2017.08)

(58) Field of Classification Search

CPC ..... B31B 50/28; B31B 2105/00; B31B 2105/0022; B31B 2120/30; B31B 2120/40; B65D 5/50; B65D 5/5016; B65D 5/5019; B65D 5/5028; B65D 5/503; B65G 17/20; B65G 19/025

USPC ..... 198/468.4, 468.6, 465.4; 493/93–96, 110

See application file for complete search history.

(56) References Cited

U.S. PATENT DOCUMENTS 2,782,978 A * 2/1957 Karr ..... B65D 5/5028 229/125.05
2,837,261 A 6/1958 Stenger
2,944,715 A 7/1960 Vergobbi
3,289,384 A 12/1966 Kraut
3,322,263 A 5/1967 Gulliver
3,334,734 A 8/1967 Meyers
3,406,814 A 10/1968 Gulliver
3,416,656 A 12/1968 Addiego
3,442,372 A 5/1969 Carmichael
3,446,419 A 5/1969 Mueller
3,550,833 A 12/1970 Rahenkamp
3,669,337 A 6/1972 Struble
3,877,630 A 4/1975 Silver
3,964,953 A * 6/1976 Mitchard ..... B32B 29/002 493/379
3,988,195 A * 10/1976 Henderson ..... B31B 70/8122 156/583.9
3,998,136 A 12/1976 Peters, Jr.
4,066,008 A 1/1978 Arvanigian
4,087,003 A 5/1978 Adamek
4,186,868 A 2/1980 Coleman
4,242,949 A * 1/1981 Auckenthaler ..... B31F 1/0054 493/276
4,315,752 A * 2/1982 Moen ..... B31D 5/0004 493/449
4,328,896 A 5/1982 Behne
4,368,052 A * 1/1983 Bitsky ..... B31B 50/624 493/295
4,563,169 A * 1/1986 Virta ..... B31B 50/00 493/126
4,608,038 A * 8/1986 Virta ..... B31B 50/00 493/110
4,650,448 A * 3/1987 Urso ..... B31B 50/00 493/110
4,717,371 A * 1/1988 Everman ..... B31B 50/00 156/558
4,757,900 A * 7/1988 Misset ..... B65D 5/5028 53/442
4,932,930 A * 6/1990 Coalier ..... B31B 50/00 493/127
4,946,540 A * 8/1990 Mitchard ..... B31B 50/00 156/364
5,035,683 A 7/1991 Takeda
5,085,623 A * 2/1992 Mitchard ..... B31B 50/252 271/247
5,086,925 A * 2/1992 Coalier ..... B65D 5/5028 53/442
5,108,355 A * 4/1992 Walsh ..... B31B 50/81 493/110
5,147,271 A 9/1992 Bacques
5,160,307 A * 11/1992 Bacques ..... B65D 5/029 493/295
5,224,919 A * 7/1993 Walsh ..... B31B 50/00 493/110
5,256,129 A 10/1993 Boix Jaen
5,388,701 A 2/1995 Ridgeway
5,393,291 A 2/1995 Wingerter
5,400,955 A * 3/1995 Coalier ..... B31B 50/52 229/116
5,447,487 A * 9/1995 Alberto ..... B31B 50/00 493/379
5,566,827 A * 10/1996 Janhonen ..... B65D 77/26 206/424
5,624,368 A 4/1997 Cromwell
5,656,006 A 8/1997 East
5,656,007 A 8/1997 Olson et al.
5,893,462 A * 4/1999 Ridgeway ..... B65D 5/5028 206/583
6,015,084 A * 1/2000 Mathieu ..... B65D 5/566 493/94
6,106,450 A 8/2000 Brittain
6,148,590 A * 11/2000 Ridgeway ..... B65D 81/075 206/583
6,319,183 B1 11/2001 Ballos, III
6,773,385 B2 * 8/2004 Johnson ..... B31B 50/00 493/93
6,899,229 B2 5/2005 Dennison
6,955,518 B1 10/2005 Hagel
7,322,171 B2 1/2008 Bonnain
7,445,589 B2 11/2008 Jaen
7,857,743 B2 12/2010 Barner
8,105,223 B2 1/2012 Graham
8,485,420 B2 7/2013 Barner
8,777,097 B2 7/2014 Jacomelli et al.
8,800,745 B2 * 8/2014 Spangler ..... B65G 35/063 198/465.4
2002/0134052 A1 * 9/2002 Bernardo ..... B65D 5/5028 53/449
2003/0100420 A1 * 5/2003 Lund ..... B31B 50/006 493/51
2003/0119640 A1 6/2003 Jaen
2003/0162642 A1 * 8/2003 Johnson ..... B31B 50/00 493/93
2003/0197051 A1 * 10/2003 Muise ..... B65D 5/606 229/117.27
2004/0214704 A1 * 10/2004 Gardner ..... B31B 50/00 493/59
2005/0011807 A1 * 1/2005 Dennison ..... B65D 5/5028 206/583
2005/0079965 A1 4/2005 Moshier
2005/0159283 A1 7/2005 Jaen
2007/0037682 A1 2/2007 Scholtes
2007/0191201 A1 8/2007 Reuteler
2007/0290025 A1 12/2007 Hirschey
2008/0039308 A1 2/2008 Herrin
2008/0067225 A1 * 3/2008 Moore ..... B65B 5/028 229/194
2008/0078819 A1 4/2008 Strong
2008/0120947 A1 5/2008 Oldsen
2008/0142407 A1 6/2008 Moore
2008/0210591 A1 9/2008 Cheich

(56) References Cited

U.S. PATENT DOCUMENTS

| | | | | |
|---|---|---|---|---|
| 2008/0250759 | A1 | 10/2008 | Cash | |
| 2009/0098991 | A1 | 4/2009 | Graham | |
| 2010/0219232 | A1 | 9/2010 | Smith | |
| 2010/0263333 | A1* | 10/2010 | Langen | B65D 5/02 53/563 |
| 2010/0264200 | A1* | 10/2010 | Jacomelli | B65D 5/328 493/84 |
| 2011/0053746 | A1* | 3/2011 | Desertot | B31D 1/005 493/102 |
| 2011/0065559 | A1 | 3/2011 | Atoui | |
| 2011/0281705 | A1 | 11/2011 | Aganovic | |
| 2012/0100976 | A1 | 4/2012 | Graham | |
| 2012/0267425 | A1* | 10/2012 | Whiteside | B65D 5/5028 493/52 |
| 2012/0280027 | A1* | 11/2012 | Whiteside | B65D 5/5035 493/162 |
| 2014/0197146 | A1* | 7/2014 | Forlong | B23Q 11/1069 219/121.84 |
| 2014/0238134 | A1* | 8/2014 | Reiter | B31B 50/00 73/584 |
| 2015/0175293 | A1* | 6/2015 | Jacomelli | B31B 50/62 229/199 |
| 2016/0280407 | A1 | 9/2016 | Lindt et al. | |
| 2016/0297600 | A1* | 10/2016 | McDonald | B65B 5/026 |
| 2017/0021960 | A1* | 1/2017 | Whiteside | B31B 50/624 |
| 2017/0080666 | A1 | 3/2017 | Graham et al. | |
| 2017/0080667 | A1* | 3/2017 | Graham | B31B 50/10 |
| 2017/0320608 | A1* | 11/2017 | Schuster | B65B 43/265 |
| 2018/0244009 | A1* | 8/2018 | Graham | B65D 5/606 |

FOREIGN PATENT DOCUMENTS

| | | | |
|---|---|---|---|
| FR | 2506722 | A1 | 12/1982 |
| FR | 2625173 | A1 | 6/1989 |
| FR | 2782981 | A1 | 3/2000 |
| FR | 2828170 | A1 | 2/2003 |
| FR | 2853885 | B1 | 8/2006 |
| GB | 2343885 | B | 5/2003 |
| GB | 2437725 | A | 11/2007 |
| GB | 2474068 | A | 4/2011 |
| JP | S6186309 | A | 5/1986 |
| WO | 2006035190 | A1 | 4/2006 |
| WO | 2006035211 | A2 | 4/2006 |
| WO | 2011042706 | A1 | 4/2011 |
| WO | 2011042707 | A1 | 4/2011 |
| WO | 2012017206 | A1 | 2/2012 |

OTHER PUBLICATIONS

Office Action, dated May 28, 2015, for Mexican patent application No. MX/a/2010/012003, with English-language translation.

Loiskandl, Design Engineering Magazine, Nov./Dec. 2012, pp. 22 and 24.

* cited by examiner

METHODS AND MACHINE FOR FORMING A SHIPPING CONTAINER WITH AN ARTICLE RETAINING WEB

CROSS-REFERENCE TO RELATED APPLICATIONS

This application is a continuation application of U.S. patent application Ser. No. 15/757,794, filed Mar. 6, 2018, which is a U.S. National Stage application of International Pat. App. No. PCT/US2016/051502, filed Sep. 13, 2016, which is a continuation of and claims the benefit of priority to U.S. patent application Ser. No. 14/860,457, filed Sep. 21, 2015, each of which is hereby incorporated by reference herein in its entirety.

BACKGROUND

This disclosure relates generally to a machine for forming containers from a blank of sheet material, and more specifically to methods and a machine for forming a blank assembly including a retaining web coupled to the blank, and/or forming a shipping container having an article retaining web from the blank assembly.

Containers fabricated from paperboard and/or corrugated paperboard material are often used to store and transport goods. Such containers are usually formed from blanks of sheet material that are folded along a plurality of preformed fold lines to form an erected corrugated container. At least some known blanks include opposing end panels, opposing side panels, a glue panel, bottom panels, and, in some cases, a top panels, connected by a plurality of fold lines. The panels are rotated to form end walls, side walls, a bottom wall, and a top wall of the container. Moreover, at least some known containers are formed using a machine. As just one example, a blank may be positioned near a mandrel on a machine, and the machine may be configured to wrap the blank around the mandrel to form at least a portion of the container. In at least some cases, the use of the machine greatly increases a rate at which the containers may be formed and/or filled with goods.

These shipping containers are often used to ship products or articles purchased by customers from an online merchant. In today's online environment, more and more customers are avoiding the time consuming task of traveling to a "brick and mortar" store to purchase the products and goods they need for home and/or work. Rather, these customers are making their purchases online from merchants that sell these products either exclusively through an online presence or through an online presence that is in combination with physical stores. In either case, when these products or articles are purchased online, the products in most cases are shipped to the customer or to another person the customer identifies as the recipient. There is a need for containers designed to ship such products.

In at least some known cases, when such products are placed inside these known shipping containers additional packing material, such as packing peanuts, styrofoam popcorn, packing noodles, foam sheets, balled-up paper sheets or some other cushioning material, is also placed inside the container to prevent damage to fragile objects during shipping. This additional packing material is a significant expense for the merchants shipping their products, and requires a significant amount of space to store such packing material.

Accordingly, it is desirous to have a shipping container that includes a means for retaining or securing a product within the container to prevent the product from being damaged from shifting around during shipment, wherein the retaining means is inexpensive, easily used, and does not require much storage space. It is also desirous to have such a shipping container formable from the blank using a machine.

BRIEF DESCRIPTION

In one embodiment, a method for forming a container using a machine, the container including a retaining web coupled to an interior thereof, includes extracting a blank from a magazine, transferring the blank in a blank transfer direction X, and positioning the blank on a deck. The method also includes translating a pick-up assembly from a first end to a second end along a horizontal direction Y perpendicular to the blank transfer direction X, including transferring a web from a first location proximate the first end to a second location proximate the second end. The method further includes depositing, at the second location, the web into an at least partially overlying relationship with the blank positioned on the deck to form a blank assembly, transferring the blank assembly along the deck in the blank transfer direction X while translating the pick-up assembly from the second end back to the first end, and wrapping the blank assembly around a mandrel to at least partially form the container.

In another embodiment, a method for forming a blank assembly using a machine, the blank assembly including a blank and a retaining web coupled to the blank, includes placing the blank in a first position on a deck, and translating a pick-up assembly from a first end to a second end along a direction Y, the translating including transferring a web from a first location proximate the first end to a second location proximate the second end. The method also includes depositing, at the second location, the web into an at least partially overlying relationship with the blank positioned on the deck to form a blank assembly, and compressing the web against the blank on the deck, using a first compression member coupled to the pick-up assembly via at least one spring.

In one embodiment, a machine for forming a blank assembly having a blank and a retaining web coupled to the blank is provided. The machine includes a deck coupled to a frame, and a blank transfer assembly coupled to the frame. The blank transfer assembly is configured to position the blank on the deck. The machine also includes a web transfer assembly coupled to the frame and extending from a first end to a second end. The web transfer assembly includes a pick-up assembly moveable between the first end and the second end. The pick-up assembly is configured to pick up the web proximate the first end and deposit the web proximate the second end in an at least partially overlying relationship with the blank positioned on the deck. The machine further includes a first compression member configured to compress a coupling region of the web against the blank on the deck to form the blank assembly.

In another embodiment, a machine for forming a container having a retaining web coupled to an interior of the container is provided. The machine includes a deck coupled to a frame, and a blank transfer assembly coupled to the frame. The blank transfer assembly is configured to position a blank on the deck. The machine also includes a web transfer assembly coupled to the frame and extending from a first end to a second end. The web transfer assembly includes a pick-up assembly moveable between the first end and the second end. The pick-up assembly is configured to transfer the web from proximate the first end and deposit the web proximate the second end in an at least partially overlying relationship with the blank positioned on the deck. The machine further includes a mandrel wrapping section that includes a mandrel mounted to the frame. The mandrel has an external shape complementary to an internal shape of at least a portion of the container. The mandrel wrapping section is configured to wrap at least a portion of the blank assembly around the mandrel to at least partially form the container.

In another embodiment, a method for forming a blank assembly using a machine is provided. The blank assembly includes a blank and a retaining web coupled to the blank. The method includes positioning the blank on a deck coupled to a frame of the machine. The method also includes transferring the web from proximate a first end of a web transfer assembly to proximate a second end of the web transfer assembly using a pick-up assembly of the machine. The method further includes depositing the web proximate the second end of the web transfer assembly in an at least partially overlying relationship with the blank positioned on the deck, and compressing a coupling region of the web against the blank on the deck to form the blank assembly using a first compression member of the machine.

DETAILED DESCRIPTION

The methods and machine described herein for forming a blank assembly including a retaining web coupled to the blank, and/or for forming a shipping container with an article-retaining web from the blank assembly, overcome the limitations of forming and safely packing known shipping containers. The methods and machine described herein include a blank transfer assembly configured to position the blank on the deck. The methods and machine described herein also include a web transfer assembly configured to pick and place a cut section of retaining web material in an at least partially overlying relationship with the blank positioned on the deck. In certain embodiments, the methods and machine described herein further include a compression member, coupled for example to the web transfer assembly, configured to compress a coupling region of the web against the blank on the deck to form the blank assembly. In some embodiments, the methods and machine described herein further include a mandrel wrapping section configured to wrap at least a portion of the blank assembly around the mandrel to form the container.

Figure 1:
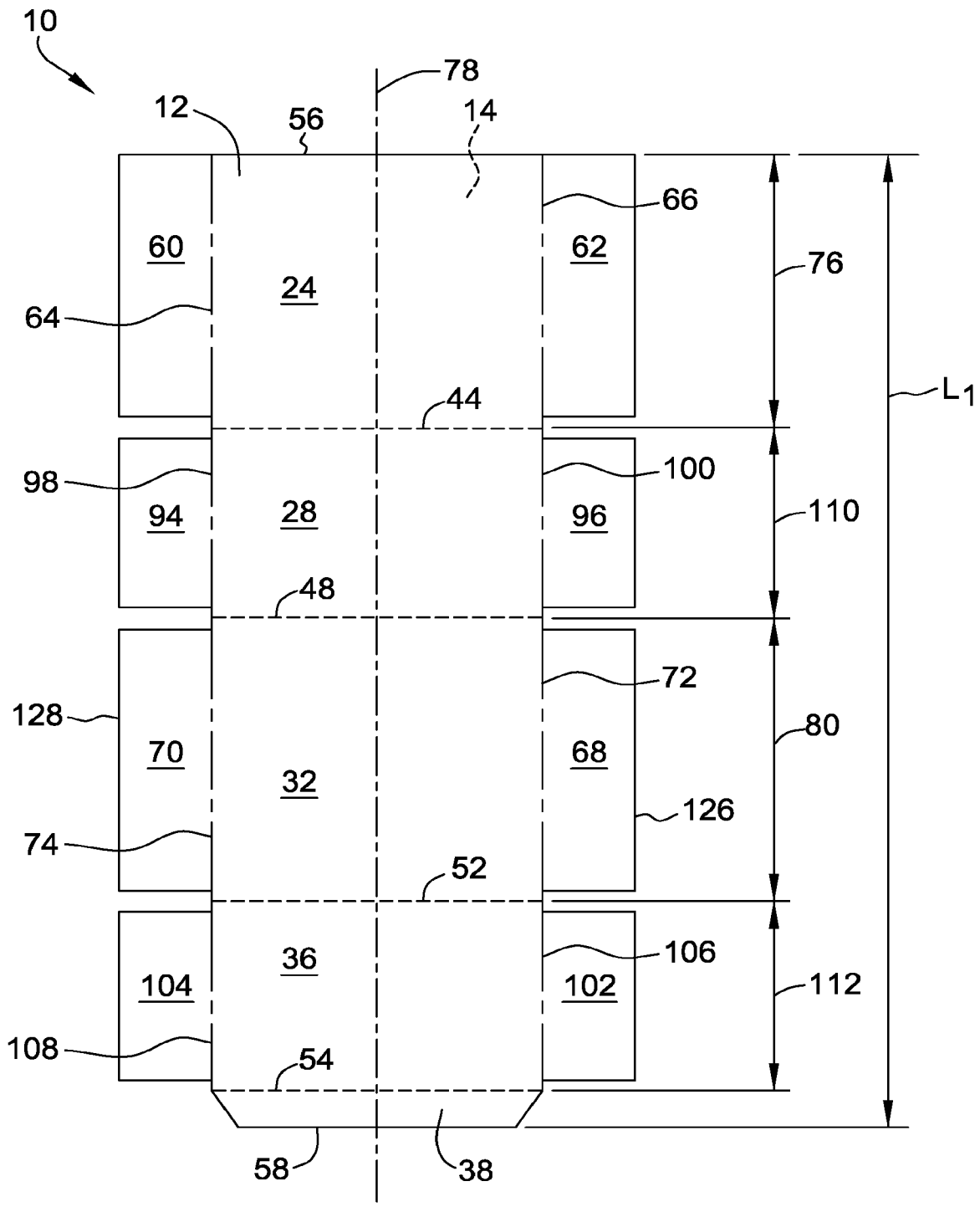
FIG. 1 is a top plan view of an example embodiment of a blank of sheet material that may be used with the machine described herein for forming a shipping container with a retaining web.

FIG. 1 illustrates a top plan view of an example embodiment of a substantially flat blank 10 of sheet material. As shown in FIG. 1, blank 10 has an interior surface 12 and an exterior surface 14. In certain embodiments, portions of exterior surface 14 and/or interior surface 12 of blank 10 include printed graphics, such as advertising and/or promotional materials.

Blank 10 extends from a leading edge 126 to a trailing edge 128 and includes a series of aligned side panels connected together by a plurality of preformed, generally parallel, fold lines defined generally perpendicular to leading edge 126 and trailing edge 128. Specifically, the side panels include a first side panel 24, a first end panel 28 (also referred to as a rear end panel 28), a second side panel 32, a second end panel 36 (also referred to as a front end panel 36), and a glue panel 38 connected in series along a plurality of parallel fold lines 44, 48, 52, and 54. First side panel 24 extends from a first free edge 56 to fold line 44, first end panel 28 extends from first side panel 24 along fold line 44, second side panel 32 extends from first end panel 28 along fold line 48, second end panel 36 extends from second side panel 32 along fold line 52, and glue panel 38 extends from second end panel 36 along fold line 54 to a second free edge 58. Blank 10 has a length $L_1$ between first free edge 56 and second free edge 58.

A first top side panel 60 and a first bottom side panel 62 extend from opposing edges of first side panel 24. More specifically, first top side panel 60 and first bottom side panel 62 extend from first side panel 24 along a pair of opposing preformed, generally parallel, fold lines 64 and 66, respectively. Similarly, a second bottom side panel 68 and a second top side panel 70 extend from opposing edges of second side panel 32. More specifically, second bottom side panel 68 and second top side panel 70 extend from second side panel 32 along a pair of opposing preformed, generally parallel, fold lines 72 and 74, respectively. Fold lines 64, 66, 72, and 74 are generally parallel to each other and generally perpendicular to fold lines 40, 44, 48, and 52. First side panel 24 has a width 76 taken along a central horizontal axis 78 of blank 10 that is substantially equal to width 80 taken along central horizontal axis 78 of second side panel 32.

As shown in FIG. 1, a first top end panel 94 and a first bottom end panel 96 extend from opposing edges of first end panel 28. More specifically, first top end panel 94 and first bottom end panel 96 extend from first end panel 28 along a pair of opposing preformed, generally parallel, fold lines 98 and 100, respectively. Similarly, a second bottom end panel 102 and a second top end panel 104 extend from opposing edges of second end panel 36. More specifically, second bottom end panel 102 and second top end panel 104 extend from second end panel 36 along a pair of opposing preformed, generally parallel, fold lines 106 and 108, respectively. Fold lines 98, 100, 106, and 108 are generally parallel to each other and generally perpendicular to fold lines 44, 48, 52, and 54. First end panel 28 has a width 110 taken along central horizontal axis 78 of blank 10 that is substantially equal to width 112 of second end panel 36, also taken along central horizontal axis 78.

Figure 3:
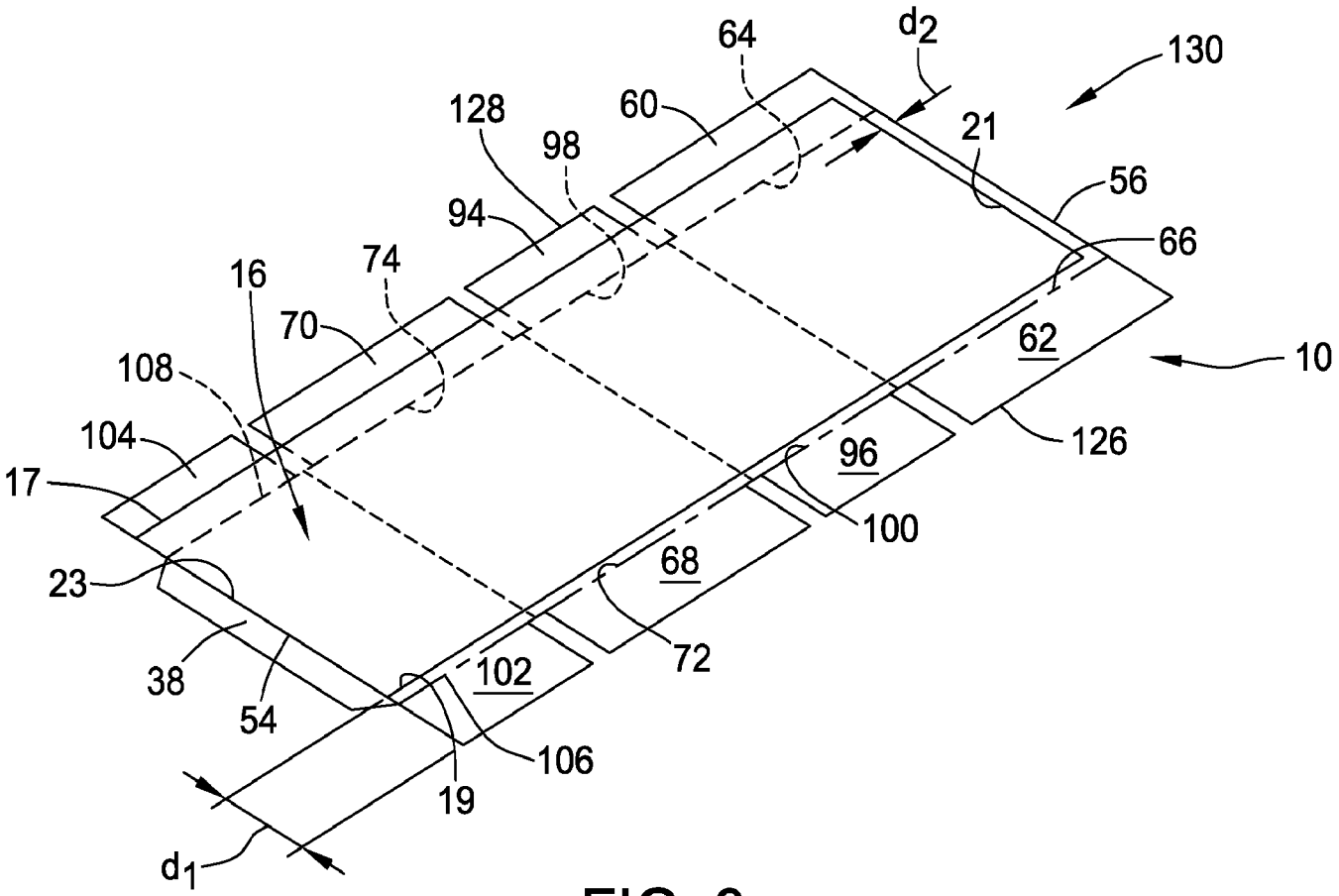
FIG. 3 is a perspective view of an example embodiment of a blank assembly that includes the blank shown in FIG. 1 and the web shown in FIG. 2.
Figure 4:
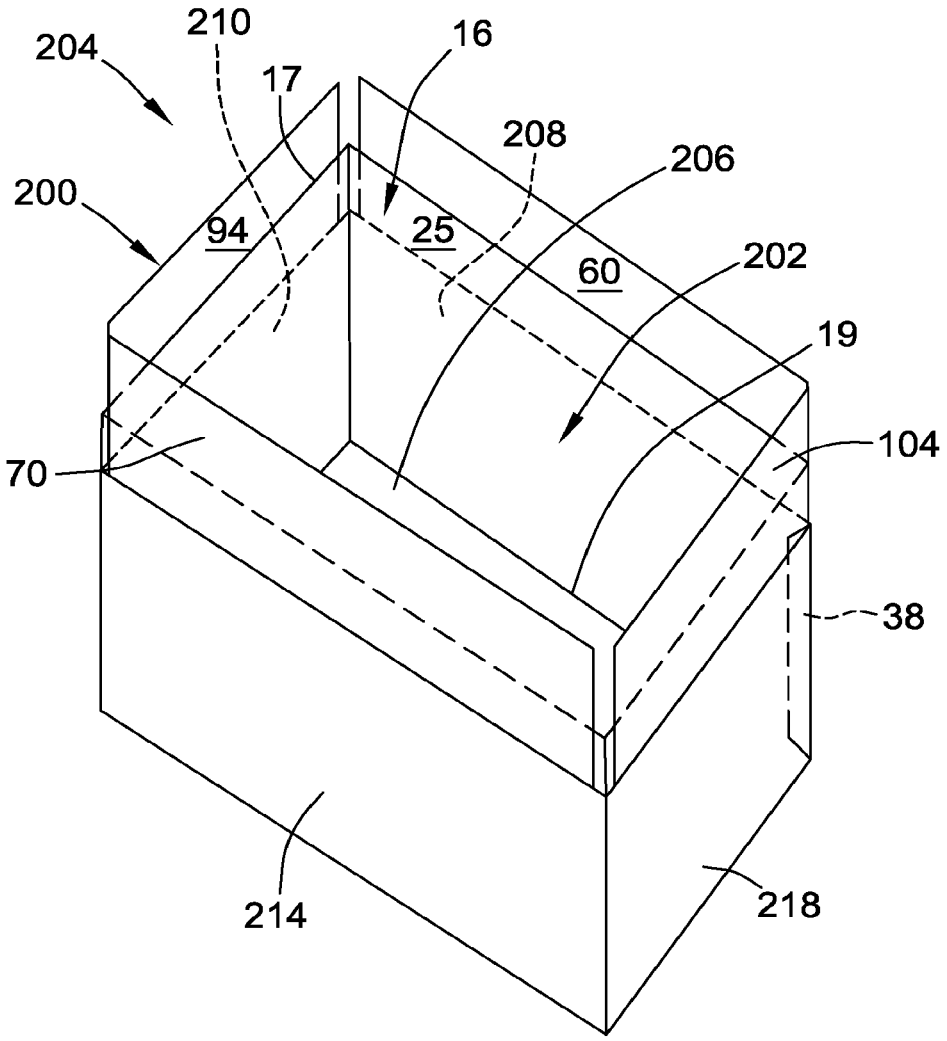
FIG. 4 is a perspective view of an example container formed from the blank assembly shown in FIG. 3 in a filling or open configuration.
Figure 5:
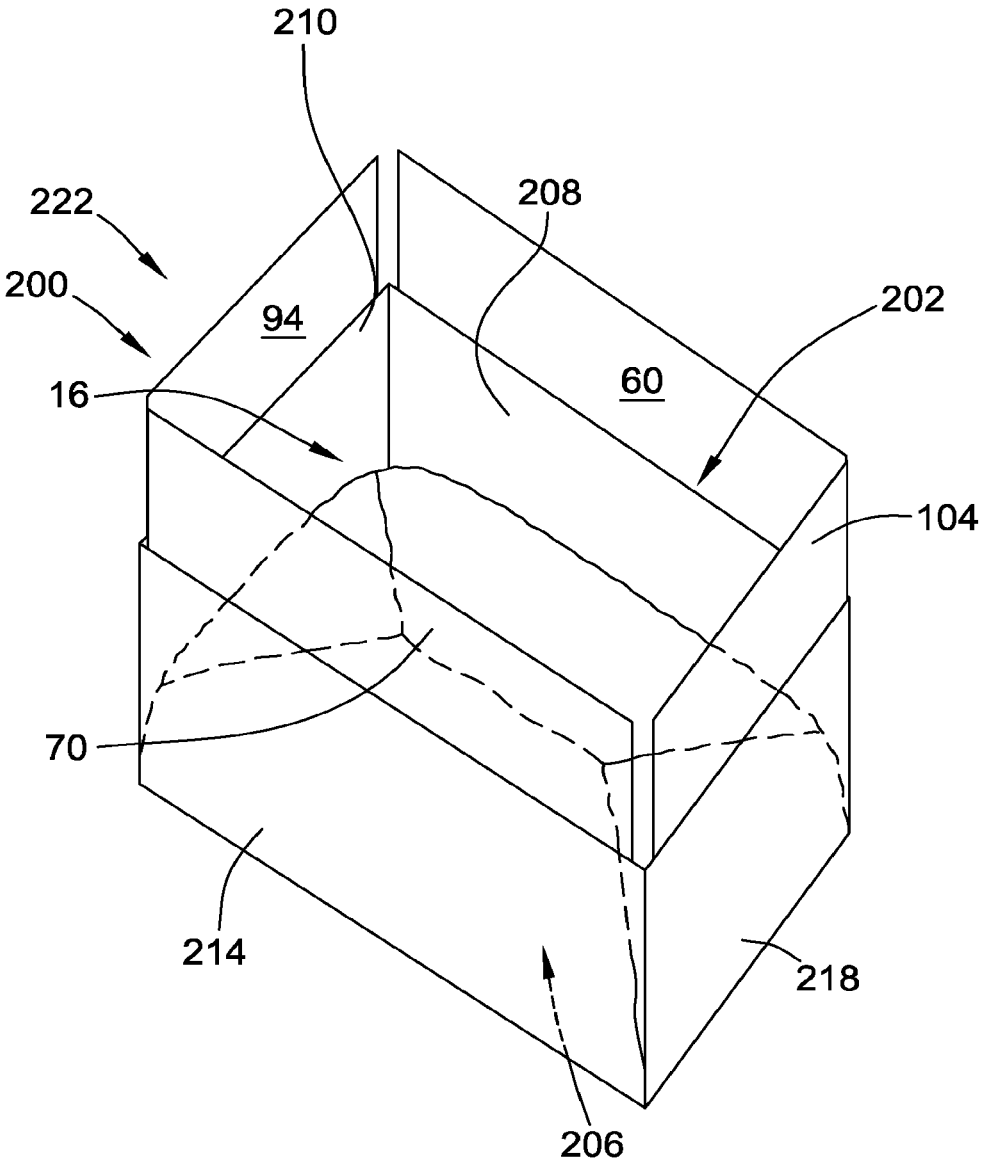
FIG. 5 is a perspective view of the container shown in FIG. 4 in a partially packed configuration.
Figure 6:
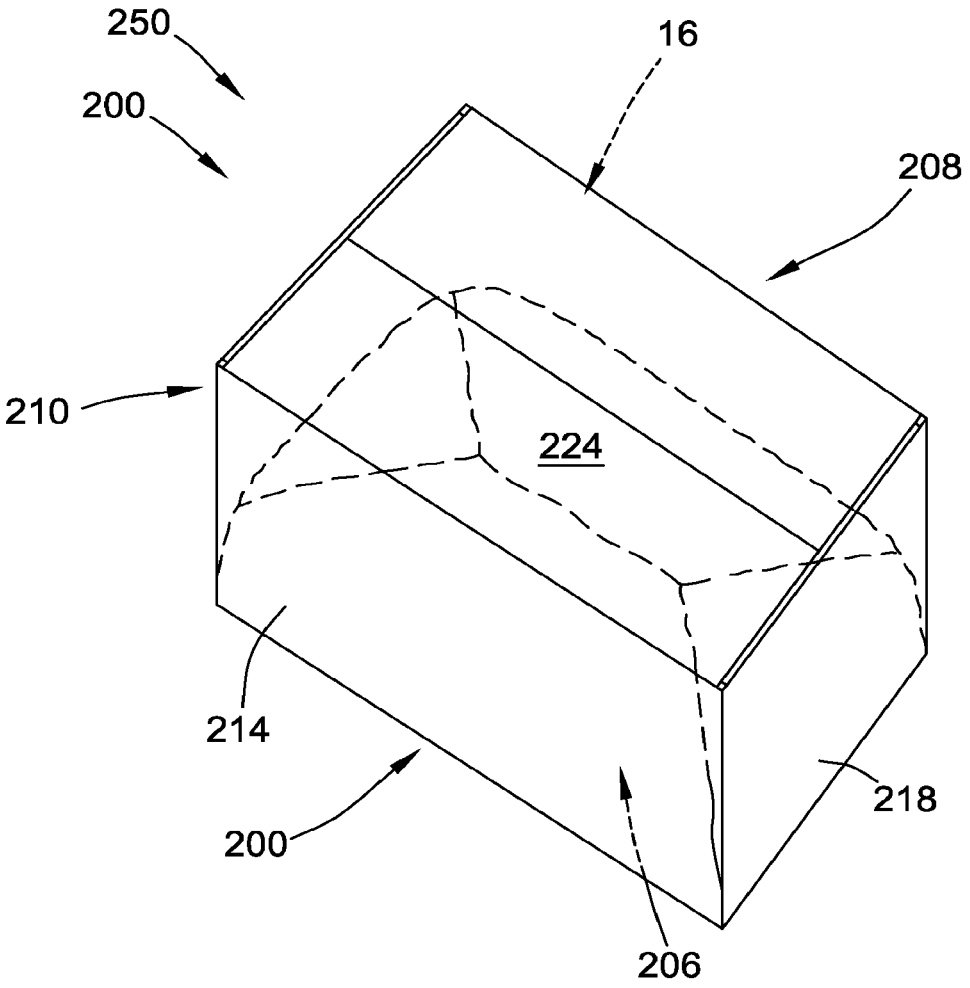
FIG. 6 is a perspective view of the container shown in FIG. 4 in a fully packed configuration.

As will be described below in more detail with reference to FIGS. 2-6, blank 10 is intended to at least partially form container 200 as shown in FIGS. 4-6 by folding and/or securing panels 24, 28, 32, 36, and/or 38 (shown in FIG. 1) and bottom panels 62, 68, 96, and/or 102 (shown in FIG. 1). Of course, blanks having shapes, sizes, and configurations different from blank 10 described and illustrated herein may be used to form container 200 shown in FIGS. 4-6 without departing from the scope of the present invention. In other words, the machine and processes described herein can be used to form a variety of different shaped and sized containers, and is not limited to blank 10 shown in FIG. 1 and/or container 200 shown in FIGS. 1-6. For example, blank 10 is shown as a four-sided container, but could be a six-sided container, an eight-sided container, or an N-sided container without departing from the scope of this disclosure.

Figure 2:
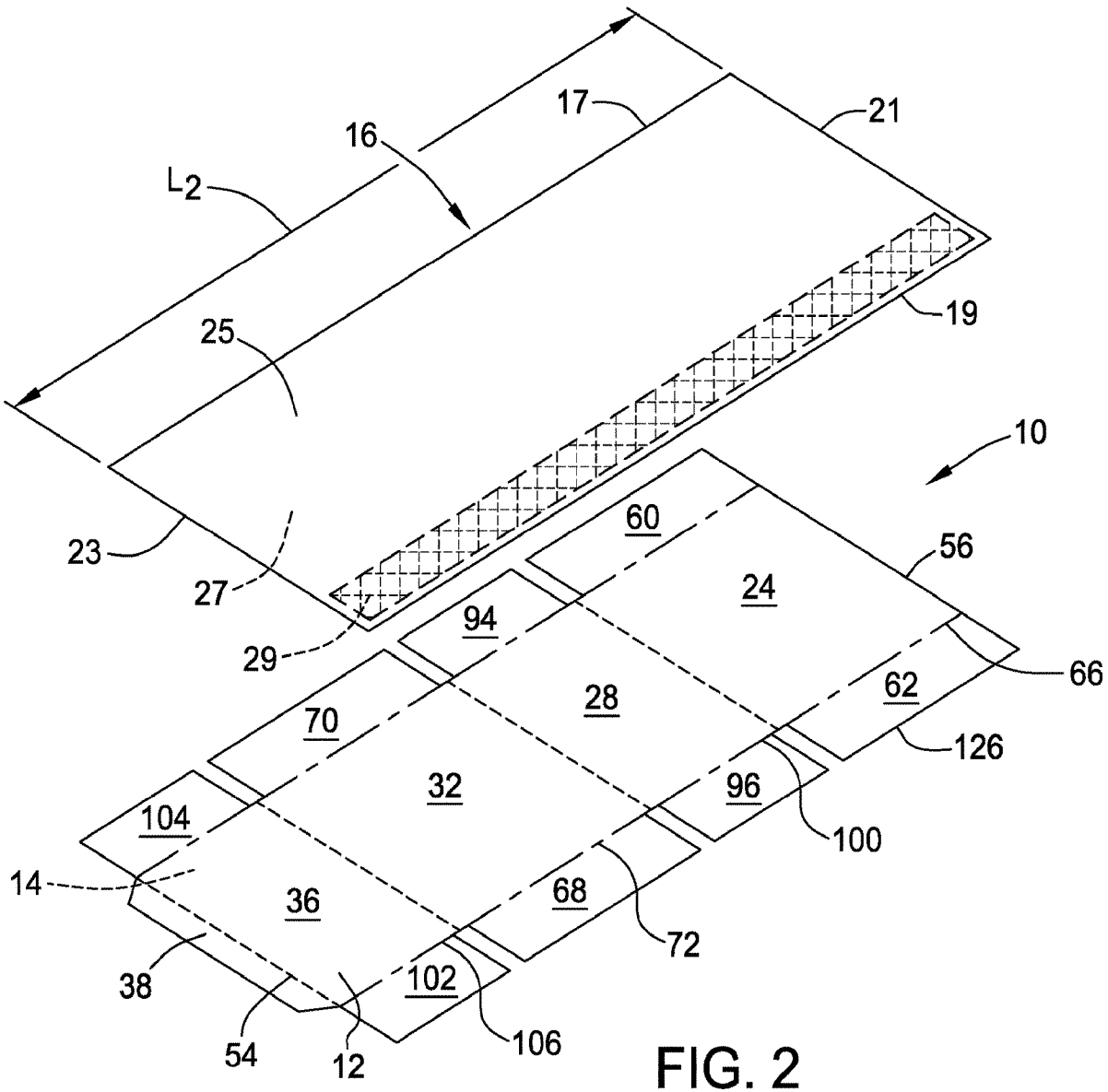
FIG. 2 is perspective view of an example embodiment of the blank of sheet material shown in FIG. 1 along with the retaining web.

FIG. 2 is a perspective view of blank 10 in relationship to a retaining web 16. In the example embodiment, web 16 is a unitary sheet. In alternative embodiments, web 16 is formed from multiple sheets. In the example embodiment, web 16 is formed from a liner paper material. In certain embodiments, web 16 is formed from one or more materials having substantially identical recycling characteristics to a material from which blank 10 is formed. In alternative embodiments, web 16 is formed from any suitable material that enables blank assembly 130 to function as described herein.

Web 16 extends from a first side free edge 21 to a second side free edge 23. A length $L_2$ of web 16 is defined between first side free edge 21 and second side free edge 23. In the example embodiment, $L_2$ is less than $L_1$ of blank 10 (shown in FIG. 1). In alternative embodiments, $L_2$ is other than less than $L_1$. Web 16 also extends from a top free edge 17 to a bottom free edge 19. Top free edge 17 and bottom free edge 19 are typically perpendicular to both first side free edge 21 and second side free edge 23. Web 16 also includes a top surface 25 and an opposite bottom surface 27. In some embodiments, web 16 has a thickness of 10 mils (0.254 millimeters) (e.g., the distance between top surface 25 and bottom surface 27).

In the example embodiment, web 16 includes a co-adhesive material applied to at least one side of top surface 25 and bottom surface 27 of web 16. With the co-adhesive applied to web 16, at least a portion of web 16 is able to securely adhere to another portion of web 16 having the co-adhesive applied thereto, such that those portions will stick together. In some embodiments, top surface 25 is coated in or otherwise includes the co-adhesive material, which is an adhesive that adheres only to surfaces coated in or otherwise including the same or similar co-adhesive material. Thus, in such embodiments, top surface 25 will adhere to itself and only itself when a first portion of top surface 25 is brought into contact with a second portion of top surface 25. In alternative embodiments, bottom surface 27 is coated in or otherwise includes the co-adhesive material. In still further alternative embodiments, both top surface 25 and bottom surface 27 are coated in or otherwise include the co-adhesive material. In any of these embodiments, web 16 is configured to be positioned such that a portion of web 16 adheres to another portion of web 16 within container 200, wherein the positioned web 16 secures a product (not shown) contained within container 200 during shipment.

As will be described below in more detail with reference to FIGS. 2-6, web 16 is intended to be attached to blank 10. In some embodiments, web 16 is adhered to blank 10 by first applying adhesive to a coupling region 29 on bottom surface 27 of web 16. Bottom surface 27 of web 16 is then placed on blank 10 (e.g., on interior surface 12 including panels 24, 28, 32, and 36) and pressure is applied to top surface 25 of web 16 and exterior 14 of blank 10 in the areas above and below, respectively, coupling region 29 such that web 16 is adhered to blank 10 to form a blank assembly 130 (shown in FIG. 3).

FIG. 3 illustrates a perspective view of blank assembly 130 which includes blank 10 with attached web 16. As will be described below in more detail with reference to FIGS. 2-6, web 16 is positioned relative to one or more features of blank 10. In some embodiments, web 16 is attached with bottom free edge 19 positioned across side panels 24, 28, 32, and 36, such that web 16 does not reach or cross fold lines 66, 100, 72, and 106. For example, in the embodiment illustrated in FIG. 3, bottom free edge 19 is spaced about ¼ inch from fold lines 66, 100, 72, and 106, such that bottom free edge 19 is positioned across side panels 24, 28, 32, and 36. In alternative embodiments, web 16 is attached with bottom free edge 19 substantially aligned with fold lines 66, 100, 72, and 106. In other alternative embodiments, there is some overlap of web 16 with bottom side panels 62 and 68 and bottom end panels 96 and 102. In those embodiments where there is overlap, the overlap of web 16 with bottom side panels 62 and 68 and bottom end panels 96 and 102 may be relatively small or it may be a substantial overlap. In the example embodiment, a first offset distance $d_1$ is defined between bottom free edge 19 of web 16 and leading edge 126 of blank 10.

In some embodiments, including the embodiment illustrated in FIG. 3, web 16 is attached to blank 10 such that first side free edge 21 is offset from first free edge 56 of blank 10 by a second predetermined offset distance $d_2$, such that interior surface 12 of blank 10 is not covered by web 16 adjacent first free edge 56. In alternative embodiments, first side free edge 21 is one of substantially aligned with first free edge 56 and offset from first free edge 56 such that web 16 overhangs first free edge 56. In some embodiments, including the embodiment illustrated in FIG. 3, web 16 is attached to blank 10 such that second side free edge 23 is substantially aligned with fold line 54 of blank 10. In alternative embodiments, second side free edge 23 covers and/or overhangs glue panel 38. In other alternative embodiments, second side free edge 23 is positioned such that it does not reach fold line 54.

In some embodiments, including the embodiment illustrated in FIG. 3, web 16 is attached to blank 10 and sized such that top free edge 17 of web 16 is positioned between fold lines 64, 98, 74, and 108 and trailing edge 128. In other words, web 16 may at least partially cover top panels 60, 70, 94, and 104. In an alternative embodiment, web 16 completely covers top panels 60, 70, 94, and 104. In a further alternative embodiment, top free edge 17 of web 16 is substantially aligned with fold lines 64, 98, 74, and 108 such that web 16 does not overlap top panels 60, 70, 94, and 104. In a further alternative embodiment, top free edge 17 of web 16 is spaced a distance from fold lines 64, 98, 74, and 108 such that web 16 only overlaps a portion of side panels 24, 28, 32, and 36.

FIG. 4 illustrates a perspective view of example container 200 that may be formed from blank assembly 130 (shown in FIG. 3), erected into a filling configuration 204 with an open top. FIG. 5 illustrates container 200 in a partially packed configuration 222 with the top panels open and with web 16 folded inwardly into a securing position with an article (not shown) secured inside of container 200. FIG. 6 illustrates container 200 in a fully packed configuration 250 with the top panels in a closed position and web 16 folded inwardly into the securing position with an article (not shown) secured inside of container 200 and ready for shipment.

For example, container 200 may be erected into filling configuration 204 and filled with product at a packing facility, and converted into partially packed configuration 222 by placing a product within container 200 and securing the product by folding down at least a portion of top free edge 17 of web 16 and cohesively securing portions of web 16 together around the product. In certain embodiments, but not by way of limitation, the product is placed directly against a bottom wall 206 of container 200, and web 16 is folded in and cohesively sealed to couple the product against bottom wall 206. The container is further converted into fully packed configuration 250 by closing the top panels. As explained below in further detail, for actual shipping purposes, a shipping label may be placed on an exterior of bottom wall 206 such that bottom wall 206 becomes the opening end of container 200 when it is received by the customer. By making bottom wall 206 the opening end of container 200 (in other words, the container is inverted for shipping with the "opening end" (i.e., the bottom wall) facing upwardly and the non-opening end (i.e., the top wall) facing downwardly), the product is suspended by web 16 within container 200 when the product is shipped such that the product is secured within container 200 and, when bottom wall 206 is opened by the customer, the product is easily viewable and removable by the customer.

Referring to FIGS. 4-6, in the example embodiment, container 200 includes a plurality of walls defining cavity 202. More specifically, container 200 in filling configuration 204, partially packed configuration 222, and fully packed configuration 250 includes bottom wall 206, a first side wall 208, a first end wall 210, a second side wall 214, and a second end wall 218. First side wall 208 includes first side panel 24 and glue panel 38, first end wall 210 includes first end panel 28, second side wall 214 includes second side panel 32, and second end wall 218 includes second end panel 36.

Although each wall 208, 210, 214, and 218 may have a different height without departing form the scope of the present disclosure, in the embodiment shown in FIGS. 1-6, each wall 208, 210, 214, and 218 has substantially the same height in filling configuration 204, partially packed configuration 222, and shipping configuration 250. Additionally, although container 200 may have other orientations without departing from the scope of the present disclosure, in the embodiments shown in FIGS. 4-6, end walls 210 and 218 are substantially parallel to each other, and side walls 208 and 214 are substantially parallel to each other and substantially perpendicular to end walls 210 and 218.

In the example embodiment, bottom panels 62, 68, 96, and 102 are each orientated generally perpendicular to walls 208, 210, 214, and 218 to form bottom wall 206. More specifically, bottom end panels 96 and 102 are folded beneath/inside of bottom side panels 62 and 68. Similarly, in shipping configuration 250 (shown in FIG. 6), top panels 60, 70, 94, and 104 are each orientated generally perpendicular to walls 208, 210, 214, and 218 to form top wall 224.

Although container 200 may be secured together using any suitable fastener at any suitable location on container 200 without departing from the scope of the present disclosure, in certain embodiments, adhesive (not shown) is applied to an inner surface and/or an outer surface of first side panel 24 and/or glue panel 38 to form first side wall 208. For example, in the embodiment illustrated in FIG. 1, blank 10 includes two areas on which adhesive is applied before or during the process in which blank 10 is formed into container 200. In the example embodiment, adhesive is disposed on exterior surface 14 of a middle portion of glue panel 38, leaving a top portion and a bottom portion of glue panel 38 free of adhesive. In addition, adhesive may be disposed on exterior surface 14 of front end panel 36.

In certain embodiments, adhesive may also be applied to exterior surfaces of bottom end panels 96 and/or 102 and/or interior surfaces of bottom side panels 62 and/or 68 to secure bottom side panels 62 and/or 68 to bottom end panels 96 and/or 102. Similarly, adhesive may also be applied to exterior surfaces of top end panels 94 and/or 104 and/or interior surfaces of top side panels 60 and/or 70 to secure top side panels 60 and/or 70 to top end panels 94 and/or 104. As a result of the above example embodiment of container 200, each of the manufacturing joints between glue panel 38 and first side panel 24, bottom wall 206, and top wall 224 may be securely closed so that various products may be securely contained within container 200.

In the example embodiment, bottom free edge 19 of web 16 is attached to blank 10 generally proximate fold lines 66, 100, 72, and 106 to form blank assembly 130, as described above, and blank assembly 130 is folded about the various preformed fold lines of blank 10 to form container 200. Thus, after container 200 is formed from blank assembly 130, for example as described with reference to FIGS. 4-6, web 16 is secured to container 200 proximate the lower edges of side walls 208, 214 and end walls 210, 218 (e.g., the edges where side walls 208, 214 and end walls 210, 218 meet bottom wall 206). Moreover, top free edge 17 is generally unattached to container 200 and extends generally proximate the upper edges of side walls 208, 214 and end walls 210, 218 (e.g., the edges where side walls 208, 214 and end walls 210, 218 meet top panels 60, 94, 70, and 104). Thus, in the example embodiment, at least a portion of bottom wall 206 is not covered by web 16. In alternative embodiments, bottom wall 206 is substantially covered by web 16.

Prior to web 16 being folded upon itself to form partially packed configuration 222, an item to be shipped or otherwise contained in container 200 is placed in container 200. In the example embodiment, the item rests at least partially on bottom wall 206 within cavity 202. At least a portion of web 16, such as but not limited to upper portions of web 16 generally adjacent top free edge 17, is then folded over onto itself in a securing position around the item. In the example embodiment, web 16 is secured to itself using the co-adhesive material applied to at least one side of web 16, to form partially packed configuration 222. Additionally or alternatively, web 16 is secured around the item using adhesive which is applied to web 16 and/or a fastener (e.g., a cable tie, wire, rubber band, and/or other fastener) to form partially packed configuration 222. Top panels 60, 94, 70, and 104 are then secured to form top wall 224 in fully packed configuration 250, as described above.

In some embodiments, web 16 secures the item to be shipped against bottom wall 206, such that the remainder of cavity 202 need not be filled with loose-fill packing materials (e.g., foam peanuts, bubble wrap, air pillows) to protect the item from shifting and/or jostling during shipping, resulting in a substantial decrease in time and material cost required to pack and ship the items. Additionally, in certain embodiments, a shipping label is placed on the exterior of bottom wall 206 (i.e., the surface of bottom wall 206 opposite cavity 202) such that bottom wall 206 becomes the opening end of container 200 when it is received by the customer. In other words, container 200 is inverted for shipping such that bottom wall 206 is the opening end of container 200, and the product is suspended by web 16 within container 200 proximate bottom wall 206. Thus, when bottom wall 206 is opened by the customer, the product is easily viewable and removable by the customer, and the amount of packing materials or other waste to be disposed of by the customer is greatly reduced.

Figure 7:
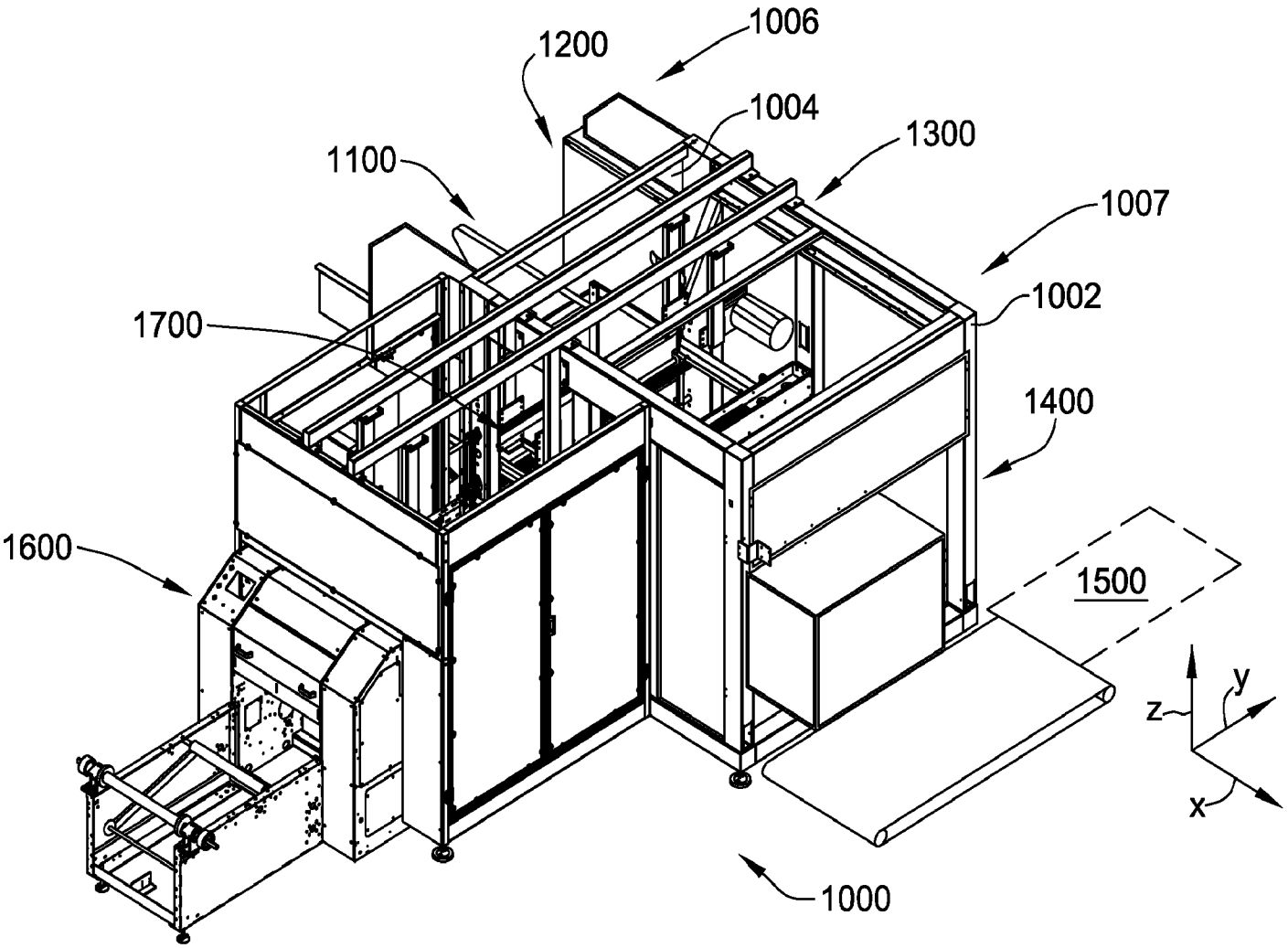
FIG. 7 is a perspective view of an example embodiment of a machine that may be used to form a container having a retaining web from the blank assembly shown in FIG. 3.

FIG. 7 is a schematic perspective view of an example machine 1000 for forming a container having a retaining web, such as container 200 (shown in FIGS. 4-6), from a blank, such as blank 10 (shown in FIGS. 1-3) and a web, such as web 16 (shown in FIGS. 2 and 3). While machine 1000 will be discussed hereafter with reference to forming container 200 from blank 10 and web 16, machine 1000 may be used to form a box or any other container having any size, shape, and/or configuration from a blank and web each having any suitable size, shape, and/or configuration without departing from the scope of the present disclosure. For one example, the containers may, but need not, include a number of sides other than four, such as, but not limited to, six or eight sides.

With reference to FIGS. 1-7, machine 1000 includes a feed section 1100, a blank transfer section 1200, a mandrel wrap section 1300, an outfeed section 1400, a web separator 1600, and a web transfer section 1700 each positioned with respect to, coupled to, and/or otherwise associated with a frame 1002. A control system 1004 is coupled in operative control communication with certain components of machine 1000. In the example embodiment, actuators are used to at least one of transfer blanks 10 and webs 16 within machine 1000, couple blanks 10 to webs 16 to form blank assembly 130, raise, lower and/or rotate one or more plates and/or folding arms that wrap blank assembly 130 around a mandrel, and to move one or more presser bars that facilitate the formation of glue joints in container 200, as will be described in more detail below. The actuators may include, for example, jacks, mechanical linkages, servomechanisms, other suitable mechanical or electronic actuators, or any suitable combination thereof. As used herein, the terms "servo-actuated" and "servo-controlled" refers to any component and/or device having its movement controlled by a servomechanism. As described herein, a control system is any suitable system that controls the movement and/or timing of at least one actuator or other mechanically or electronically driven component of machine 1000.

In certain embodiments, such as, but not limited to, embodiments where at least one servomechanism is used, control system 1004 may enable an operator to change recipes or protocols by making a selection on a user interface. The recipes are computer instructions for controlling the machine to form different size boxes, different types of boxes, and/or control the output of the formed containers. The different recipes control the speed, timing, force applied, and/or other motion characteristics of the different forming components of the machine including how the components move relative to one another.

In the example embodiment, feed section 1100 is positioned at an upstream end 1006 of machine 1000 with respect to a blank loading direction indicated by an arrow X. Transfer section 1200 is positioned downstream from feed section 1100, mandrel wrap section 1300 is positioned downstream from transfer section 1200, and outfeed section 1400 is positioned downstream from mandrel wrap section 1300 with respect to blank loading direction X, at a downstream end 1007 of machine 1000. Web transfer section 1700 is located upstream from blank transfer section 1200, and web separator 1600 is located upstream from web transfer section 1700, with respect to a direction indicated by an arrow Y, which is generally transverse to blank loading direction X. Blank loading direction X and transverse direction Y define a generally horizontal plane, with a vertical direction Z defined perpendicular to the horizontal plane. In alternative embodiments, each of feed section 1100, transfer section 1200, mandrel wrap section 1300, outfeed section 1400, web separator 1600, and web transfer section 1700 is positioned with respect to others of feed section 1100, transfer section 1200, mandrel wrap section 1300, outfeed section 1400, web separator 1600, and web transfer section 1700 in any suitable location.

In the example embodiment, a product load section 1500 is positioned with respect to machine 1000 downstream from outfeed section 1400 with respect to transverse direction Y. In alternative embodiments, product load section 1500 is positioned with respect to machine 1000 in any suitable location. For example, but not by way of limitation, product load section 1500 is located at one or more locations remote to machine 1000.

Figure 8:
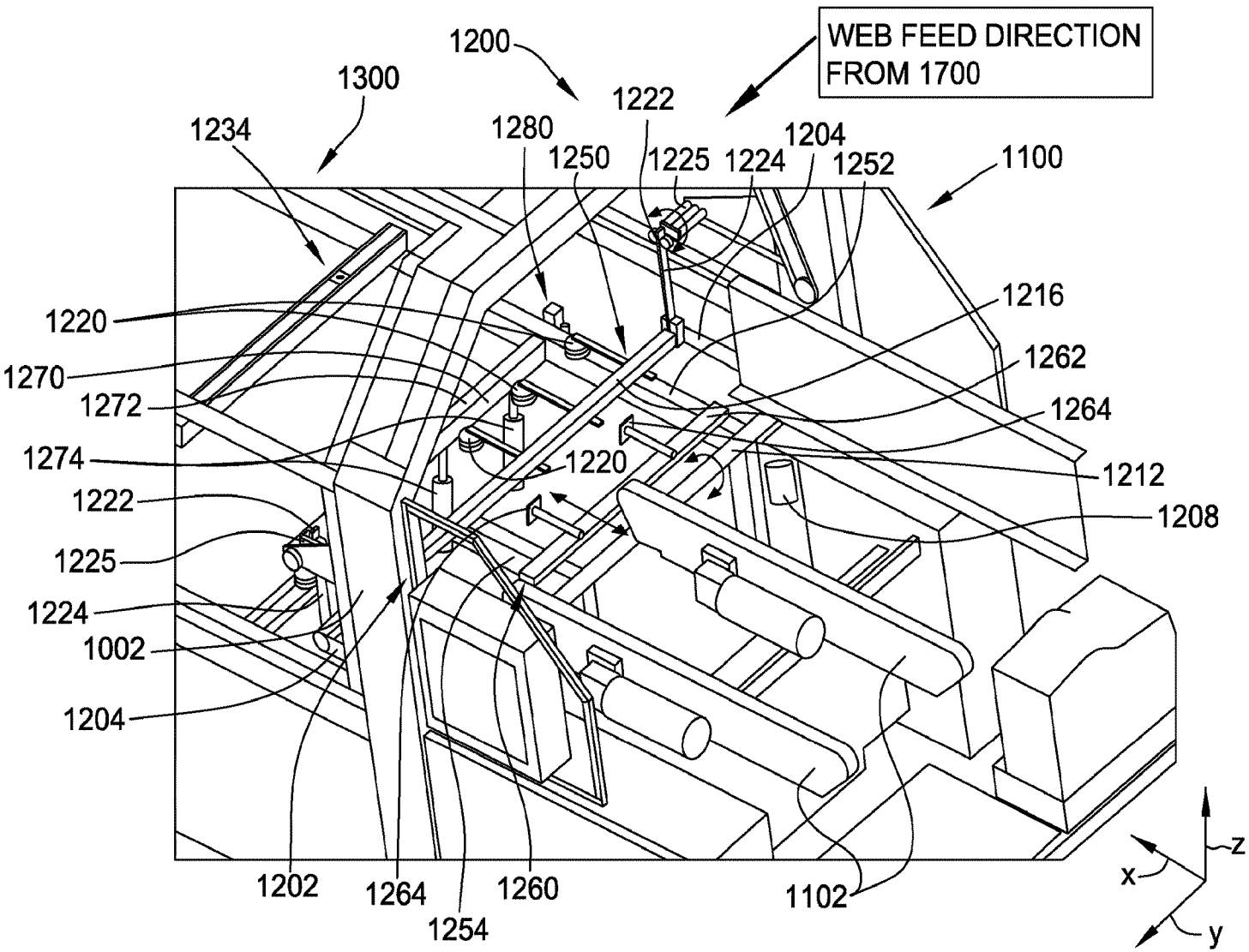
FIG. 8 is a perspective view of an example feed section and example transfer section included within the machine shown in FIG. 7.

FIG. 8 is a schematic perspective view of an example embodiment of feed section 1100 and an example embodiment of transfer section 1200 of machine 1000. Feed section 1100 is configured to receive a plurality of blanks 10. In the example embodiment, feed section 1100 is a magazine feed section that includes a plurality of powered drives 1102. For example, each magazine drive 1102 is a belt conveyor. Magazine drives 1102 are configured to move first blanks 10 towards transfer section 1200. Additionally or alternatively, feed section 1100 includes any suitable structure that enables feed section 1100 to function as described herein. In the example embodiment, blanks 10 (shown in FIG. 1) are oriented generally in the vertical direction Z within feed section 1100, such that leading edge 126 of each blank 10 is positioned against drives 1102 and interior surface 12 of each blank faces transfer section 1200. In alternative embodiments, feed section 1100 is configured to present blanks 10 in another suitable orientation, such as, but not limited to, a generally horizontal configuration. In the example embodiment, feed section 1100 includes at least one alignment device (not shown) such as, but not limited to, a stack presser, to facilitate justifying and/or aligning blanks 10 in the magazine of feed section 1100.

In the example embodiment, transfer section 1200 includes a blank transfer assembly 1202 coupled to, or otherwise associated with, frame 1002 proximate feed section 1100. Blank transfer assembly 1202 is configured to extract one of blanks 10 from feed section 1100 and position the extracted blank 10 on a deck 1250. More specifically, transfer assembly is configured to position each extracted blank 10 on deck 1250 such that leading edge 126 of blank 10 is aligned substantially at a predetermined location along deck 1250 with respect to the X direction, and first free edge 56 is aligned substantially at a predetermined location along deck 1250 with respect to the Y direction.

Deck 1250 is configured to support blank 10 in a generally horizontal position (i.e., generally parallel to the X-Y plane) as web 16 is coupled to blank 10 to form blank assembly 130. In the example embodiment, deck 1250 includes a first deck member 1252 and a second deck member 1254 coupled to frame 1002. Each of first deck member 1252 and second deck member 1254 extends generally parallel to the X direction downstream towards mandrel wrap section 1300, and first deck member 1252 is separated from second deck member 254 in transverse direction Y by a distance less than length $L_1$ of blank 10, such that blank 10 is supportable by first deck member 1252 and second deck member 1254. In alternative embodiments, deck 1250 includes any additional or alternative suitable structure that enables transfer section 1200 to function as described herein.

In the example embodiment, first blank transfer assembly 1202 includes a drive shaft 1212 supported and aligned generally parallel to the transverse Y direction by at least one bearing (not shown). Drive shaft 1212 is operably coupled to a suitable actuator 1208 for bi-directional rotation about its shaft axis. For example, actuator 1208 includes at least one of a hydraulic jack, an air cylinder, a mechanical linkage, a servomechanism, and another suitable mechanical or electronic actuator. A pair of arms 1204 extend from opposite ends of drive shaft 1212, and rotate with drive shaft 1212. A pick-up bar 1216 is aligned parallel to drive shaft 1212, and is coupled between arms 1204 for free rotation about its bar axis. A plurality of vacuum suction cups 1220 are fixedly coupled to pick-up bar 1216. Each suction cup 1220 is operably coupled to a respective independent vacuum generator (not shown) for selectively providing suction to selectively attach suction cups 1220 to blank 10 presented in feed section 1100. In alternative embodiments, at least some suction cups 1220 are coupled to a common vacuum generator. Further in the example embodiment, a respective guide rod 1224 is fixedly coupled to each end of pick-up bar 1216. Each guide rod 1224 is slidably coupled through a respective pair of rollers 1222 coupled to a respective pivot block 1225. In turn, each pivot block 1225 is pivotably coupled to frame 1002 for rotation about an axis parallel to drive shaft 1212. In alternative embodiments, first blank transfer assembly 1202 includes any suitable additional or alternative components that enable first blank transfer assembly 1202 to function as described herein.

In operation, first blank transfer assembly 1202 is controlled, commanded, and/or instructed to position suction cups 1220 to facilitate extracting blank 10 from feed section 1100 and placing blank 10 on deck 1250. More specifically, in the example embodiment, actuator 1208 is controlled, commanded, and/or instructed to rotate drive shaft 1212 in a first direction (clockwise in the view of FIG. 8). As arms 1204 rotate with drive shaft 1212, guide rods 1224 and pivot blocks 1225 cooperate to orient pick-up bar 1216 such that suction cups 1220 are positioned in sealing contact with blank 10, which is presented generally perpendicular to blank loading direction X in feed section 1100. Actuator 1208 is then controlled, commanded, and/or instructed to rotate drive shaft 1212 in a second, opposite direction (counterclockwise in the view of FIG. 8). As arms 1204 rotate with drive shaft 1212, activated suction cups 1220 extract blank 10 from feed section 1100. Moreover, guide rods 1224 and pivot blocks 1225 cooperate to rotate pick-up bar 1216 such that blank 10 is oriented generally perpendicular to vertical direction Z as pick-up bar 1216 approaches deck 1250. Finally, vacuum pressure through suction cups 1220 is controlled, commanded, and/or instructed to be de-activated, depositing blank 10 on deck 1250 such that leading edge 126 and first free edge 56 are aligned at substantially the predetermined location along deck 1250 with respect to the X and Y direction, respectively, and interior surface 12 is facing upward. In certain embodiments, actuator 1208 is then controlled, commanded, and/or instructed to rotate drive shaft 1212 in the first direction to provide clearance for other operations of machine 1000 proximate deck 1250. For example, first blank transfer assembly 1202 is rotated to extract another blank 10 and/or to pause in a neutral position to provide clearance for other operations of machine 1000 proximate deck 1250, as will be described herein. In alternative embodiments, first blank transfer assembly 1202 is operated in any suitable additional or alternative fashion that enable first blank transfer assembly 1202 to function as described herein.

Further in the example embodiment, transfer section 1200 includes a forwarding assembly 1260 coupled to, or otherwise associated with, frame 1002. After web 16 is coupled to blank 10 on deck 1250 to form blank assembly 130, as will be described herein, forwarding assembly 1260 is configured to transfer blank assembly 130 from transfer section 1200 into mandrel wrap section 1300 and, more specifically, position blank assembly 130 proximate a mandrel for forming container 200, as will be described herein.

Figure 9:
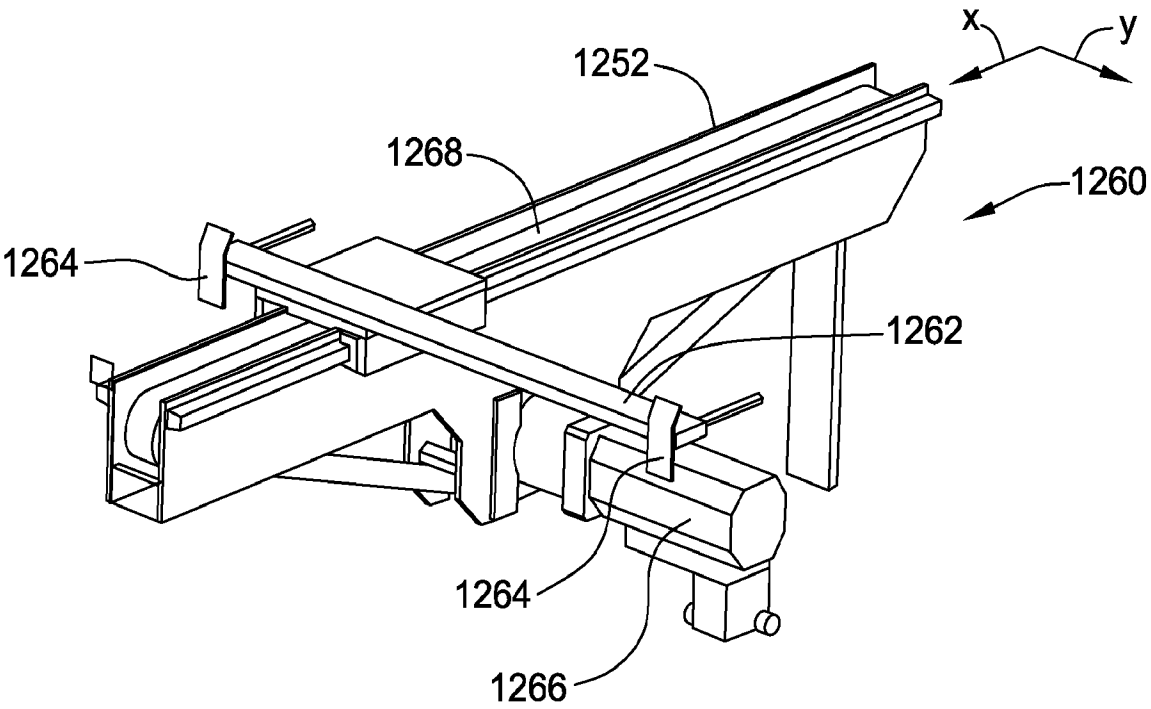
FIG. 9 is a perspective view of a portion of an example forwarding assembly for use with the machine shown in FIG. 7.

FIG. 9 is a schematic perspective view of a portion of an example embodiment of forwarding assembly 1260 for use with machine 1000. With reference to FIGS. 8 and 9, in the example embodiment, forwarding assembly 1260 includes a pusher bar 1262 operably coupled to an actuator 1266 for bi-directional translation parallel to the X direction between a first position (shown in FIG. 8) and a second position (shown in FIG. 9). For example, actuator 1266 includes at least one of a hydraulic jack, an air cylinder, a mechanical linkage, a servomechanism, and another suitable mechanical or electronic actuator. In the example embodiment, pusher bar 1262 is at least partially supported by deck members 1252 and 1254, and a drive chain 1268 coupling actuator 1266 and pusher bar 1262 also is at least partially supported by first deck member 1252. In alternative embodiments, pusher bar 1262 is supported by any suitable additional or alternative structure, and/or actuator 1266 and pusher bar 1262 are coupled by any suitable additional or alternative structure, that enables transfer section 1200 to function as described herein.

In the example embodiment, a plurality of pusher feet 1264 are fixedly coupled to pusher bar 1262. Forwarding assembly 1260 is positioned with respect to transfer section 1200 such that, when blank 10 is positioned on deck 1250 and pusher bar 1262 is in the first position, pusher feet 1264 are positioned at least slightly upstream from trailing edge 128 (shown in FIG. 1) of blank 10. Moreover, when pusher bar 1262 is moved in the X direction from the first position to the second position after blank assembly 130 is formed on deck 1250, pusher feet 1264 contact trailing edge 128 and push blank assembly 130 in the X direction from transfer section 1200 into mandrel wrap section 1300, and, more specifically, position blank assembly 130 proximate a mandrel for forming container 200, as will be described herein. For example, in the example embodiment, forwarding assembly 1260 positions blank assembly 130 directly underneath a mandrel 1312 (shown in FIG. 12). In alternative embodiments, forwarding assembly 1260 includes any suitable additional or alternative structure that enables forwarding assembly 1260 to function as described herein.

Figure 11:
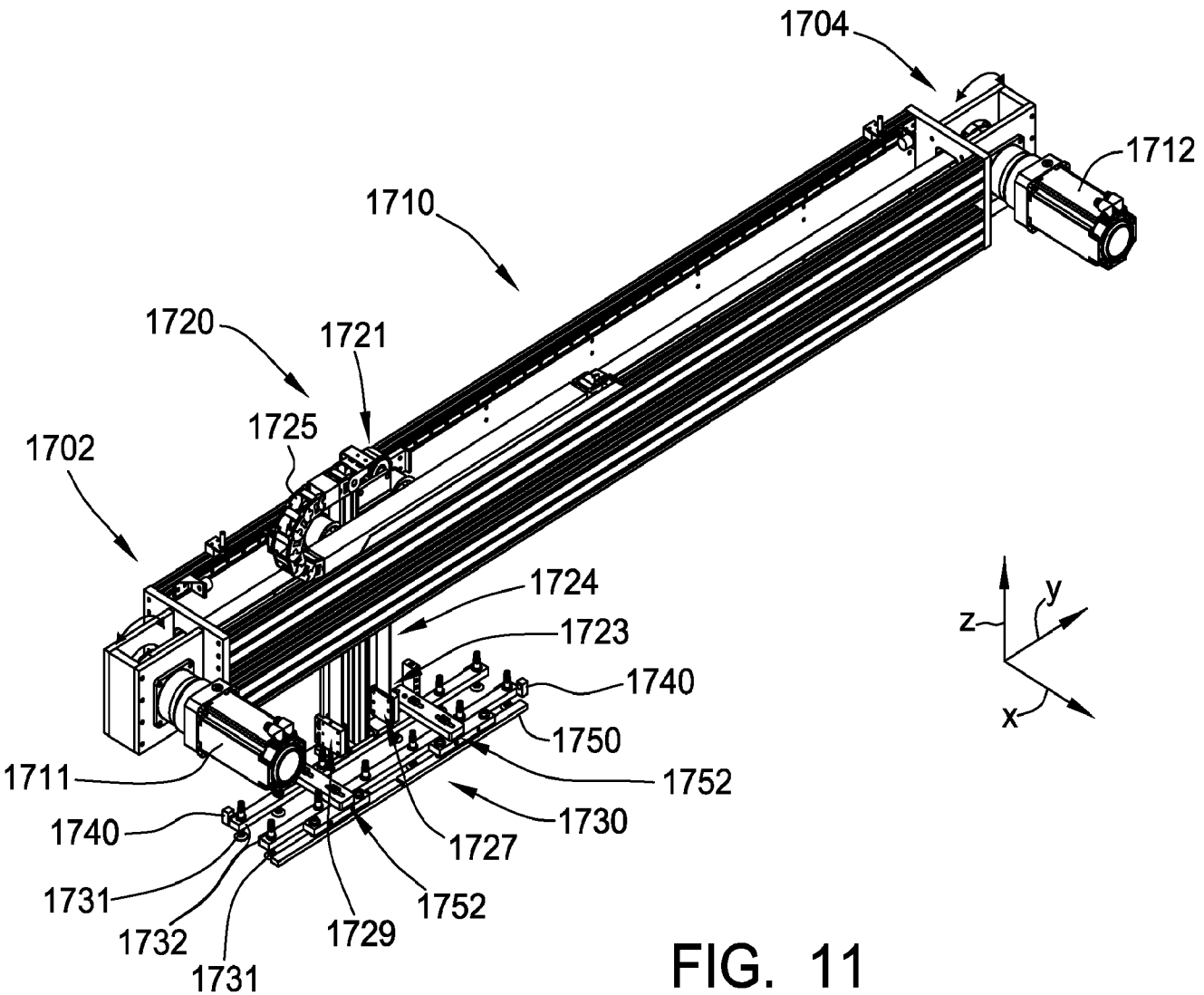
FIG. 11 is a perspective view of an example web transfer mechanism implemented in an H-bot configuration for use with the web transfer section shown in FIG. 10.

In the example embodiment, transfer section 1200 includes a second compression member 1270 (shown in FIG. 8) that extends generally parallel to transverse direction Y and is configured to cooperate with an oppositely disposed first compression member 1750 (shown in FIG. 11). A compression surface 1272 of second compression member 1270 is configured to be positioned proximate blank 10 when blank 10 is positioned on deck 1250. Moreover, a downstream edge of compression surface 1272 is configured to be offset upstream, with respect to the X direction, from leading edge 126 of blank 10 by approximately the first predetermined offset distance $d_1$ (shown in FIG. 3) when blank 10 is positioned on deck 1250. In the example embodiment, compression surface 1272 has sufficient depth in the X direction and sufficient width in the Y direction to provide a compression surface against substantially all of the region of blank 10 that is adhered to web 16 to form blank assembly 130. In alternative embodiments, compression surface 1272 has sufficient depth in the X direction and sufficient width in the Y direction to provide a compression surface against less than substantially all of the region of blank 10 that is adhered to web 16 to form blank assembly 130. In other alternative embodiments, transfer section 1200 does not include second compression member 1270. For example, a process of wrapping blank assembly 130 about mandrel 1312 in mandrel wrap section 1300 facilitates bonding coupling region 29 of web 16 to blank 10.

Further in the example embodiment, second compression member 1270 is coupled to at least one actuator 1274 for bi-directional translation generally parallel to the Z direction. For example, each actuator 1274 includes at least one of a hydraulic jack, an air cylinder, a mechanical linkage, a servomechanism, and another suitable mechanical or electronic actuator. More specifically, the at least one actuator 1274 is operable to move second compression member 1270 between a first position, in which second compression member 1270 is positioned proximate blank 10 to provide a compression surface against the region of blank 10 that is adhered to coupling region 29 of web 16 to form blank assembly 130, and a second position, in which second compression member 1270 is positioned out of a path travelled by components of forwarding assembly 1260 as forwarding assembly 1260 transfers the formed blank assembly 130 to mandrel wrap section 1300. For example, in the example embodiment, second compression member 1270 is positioned upwardly, with respect to the Z direction, in the first position and downwardly, beneath a path travelled by pusher feet 1264, in the second position. Thus, second compression member 1270 is operable to both provide an effective compression surface 1272 for facilitating bonding of web 16 to blank 10, and to avoid interference with forwarding assembly 1260 after blank assembly 130 is formed. In alternative embodiments, transfer section 1200 includes any suitable additional or alternative structure that enables second compression member 1270 to avoid interference with forwarding assembly 1260. For example, second compression member 1270 is segmented across transverse direction Y, with gaps between the segments (not shown) that allow passage of pusher feet 1264.

In the example embodiment, at least one blank adhesive applicator 1234 is positioned adjacent first blank transfer assembly 1202, such as adjacent forwarding assembly 1260, to apply adhesive to blank 10 as blank 10 is transferred to mandrel wrap section 1300. Blank adhesive applicator 1234 is coupled in communication with control system 1004. Control system 1004 controls a starting time, a pattern, an ending time, a length of adhesive bead, and/or any other suitable operations of adhesive applicator 1234. For example, control system 1004 instructs blank adhesive applicator 1234 to apply adhesive to predetermined panels of blank 10, such as glue panel 38 and/or one or more of bottom panels 62, 96, 68, 102, to facilitate forming manufacturer's joints of container 200. In alternative embodiments, machine 1000 includes any suitable structure for applying adhesive to blank 10 and/or otherwise facilitating formation of manufacturer's joints of container 200 that enables machine 1000 to function as described herein.

Figure 10:
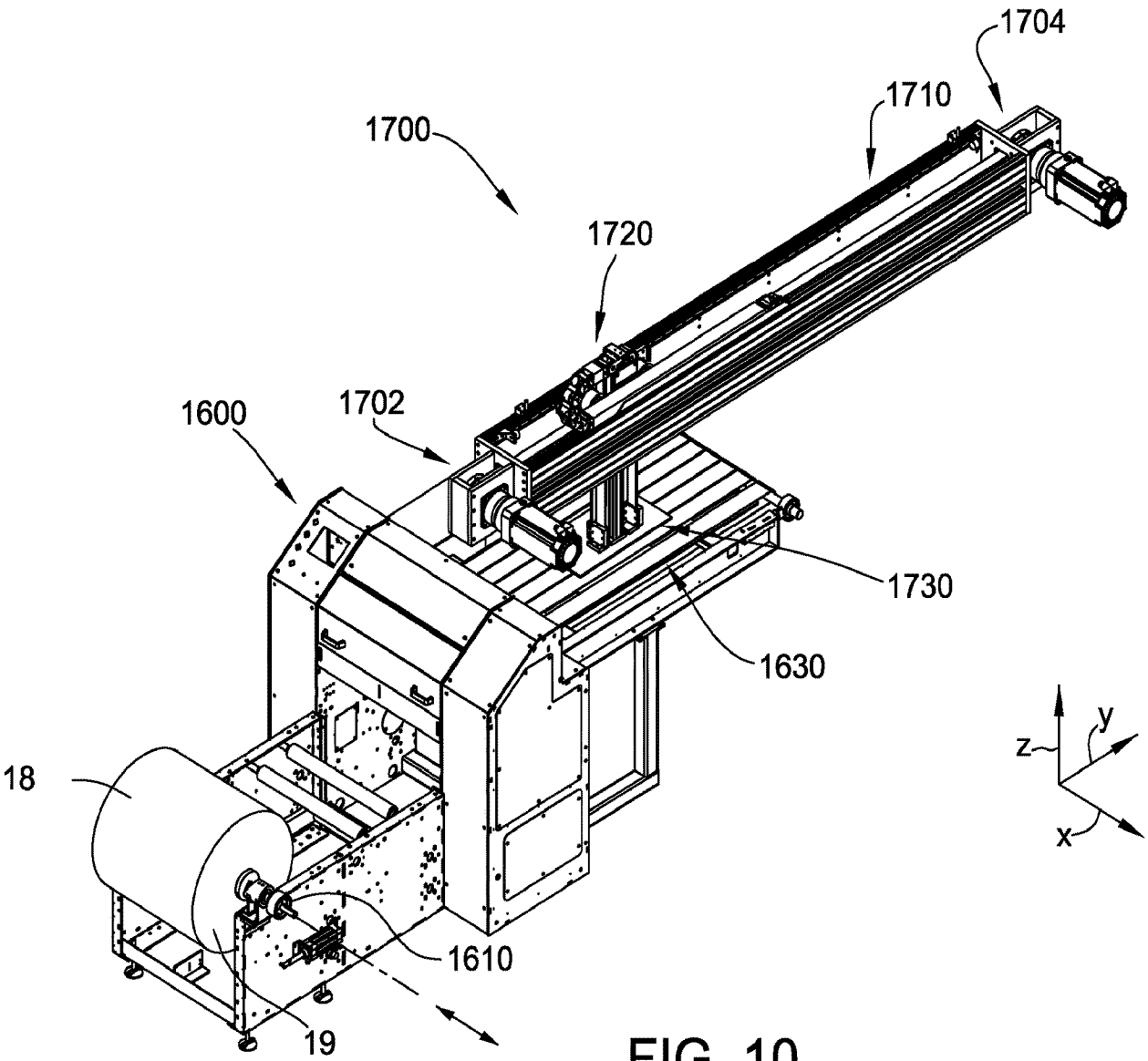
FIG. 10 is a perspective view of an example web separator and an example web transfer section for use with the machine shown in FIG. 7.

FIG. 10 is a schematic perspective view of an example embodiment of a web separator 1600 and an example embodiment of a web transfer section 1700 suitable for use with machine 1000. In the example embodiment, web separator 1600 is operable to cut sheets of predetermined length $L_2$, as shown in FIG. 2, from a roll 18 of web material to form webs 16 (shown in FIG. 2), and to deposit each web 16 sequentially on a generally horizontal platform 1630 for pick-up in web transfer section 1700. For example, web separator 1600 may include a sheeter machine, such as Rosenthal® sheeter manufactured by Rosenthal Manufacturing Co., Inc., 1840 Janke Drive, Northbrook Ill. 60062. In alternative embodiments, web separator 1600 is any other suitable mechanism for cutting roll 18 of web material into webs of predetermined length $L_2$.

In certain embodiments, roll 18 of web material includes rolled web material coated on both sides with a cohesive material, as well as a backing material (not shown) configured to prevent the cohesive material from adhering to itself between adjacent layers of the rolled web material. In such embodiments, web separator 1600 is suitably operable to remove the backing material prior to depositing each web 16 on platform 1630. In alternative embodiments, roll 18 of web material does not include a backing material. For example, roll 18 of web material includes rolled web material coated on only one side with a cohesive material, such that a potential for the cohesive material to adhere to itself between adjacent layers of the rolled web material is reduced or eliminated.

In the example embodiment, a spool receiver 1610 of web separator 1600 is slidably adjustable in a direction generally parallel to the X direction to facilitate offsetting bottom free edge 19 of web 16 from leading edge 126 of blank 10 by predetermined first offset distance $d_1$, as illustrated in FIG. 3, when web 16 is transferred to transfer section 1200. In alternative embodiments, at least one of web separator 1600 and web transfer section 1700 includes suitable additional or alternative structure to facilitate offsetting bottom free edge 19 of web 16 from leading edge 126 of blank 10 by the predetermined offset distance $d_1$.

Web transfer section 1700 is configured to pick up a cut sheet of web material, constituting web 16, from platform 1630 and deposit web 16 in an at least partially overlying relationship with blank 10 positioned on deck 1250. In the example embodiment, web transfer section 1700 includes a web transfer assembly 1710 that extends generally in transverse direction Y from a first end 1702 to an opposite second end 1704. More specifically, first end 1702 is configured to be positioned proximate platform 1630, and second end 1704 is configured to be positioned proximate deck 1250. Web transfer assembly 1710 includes a gantry 1720 operable for bi-directional translation between first end 1702 and second end 1704. In the example embodiment, a pick-up assembly 1730 is coupled to gantry 1720 for bi-directional translation with respect to gantry 1720 generally parallel to the vertical Z direction. Pick-up assembly 1730 is operable to (i) pick web 16 from platform 1630 when gantry 1720 is positioned proximate first end 1702, (ii) transport web 16 from proximate first end 1702 to proximate second end 1704, and (iii) deposit web 16 in the at least partially overlying relationship with blank 10 positioned on deck 1250 when gantry 1720 is positioned proximate second end 1704.

FIG. 11 is a schematic perspective view of an example embodiment of web transfer assembly 1710 implemented in a suitable H-bot configuration. More specifically, a lift arm 1724 is coupled to gantry 1720 for bi-directional translation relative to gantry 1720 in the Z direction. Lift arm 1724 extends generally in the Z direction from a first end 1721 to a second end 1723, and pick-up assembly 1730 is coupled to lift arm second end 1723. In addition, a first servomechanism 1711 operable for bi-directional rotation is coupled proximate first end 1702 of web transfer assembly 1710, and a second servomechanism 1712 operable for bi-directional rotation is coupled proximate second end 1704 of web transfer assembly 1710. Each servomechanism 1711 and 1712 is coupled in driving relationship with an open loop belt 1725 that extends from a first end 1727 to a second end 1729. Each of belt first end 1727 and belt second end 1729 is coupled to lift arm 1724 proximate second end 1723.

Belt 1725 is looped in a circuit, in a counterclockwise direction in the view of FIG. 11, from second end 1723 of lift arm 1724 adjacent pick-up assembly 1730, around second servomechanism 1712, around first end 1721 of lift arm 1724, around first servomechanism 1711, and back to second end 1723 of lift arm 1724, such that lift arm 1724 is carried by belt 1725. Thus, when each servomechanism 1711 and 1712 rotates in a first direction (counterclockwise in the view of FIG. 11) at a substantially identical speed, gantry 1720 translates in the Y direction with respect to transfer assembly 1710 and lift arm 1724 does not substantially translate with respect to gantry 1720; when each servomechanism 1711 and 1712 rotates in a second direction (clockwise in the view of FIG. 11) opposite the first direction at a substantially identical speed, gantry 1720 translates opposite the Y direction with respect to transfer assembly 1710 and lift arm 1724 does not substantially translate with respect to gantry 1720; when first servomechanism 1711 rotates in the second direction and second servomechanism 1712 rotates in the first direction at a substantially identical speed, gantry 1720 does not substantially translate with respect to transfer assembly 1710 and lift arm 1724 (and, hence, pick-up assembly 1730) translates with respect to gantry 1720 in the Z direction; and when first servomechanism 1711 rotates in the first direction and second servomechanism 1712 rotates in the second direction at a substantially identical speed, gantry 1720 does not substantially translate with respect to transfer assembly 1710 and lift arm 1724 (and, hence, pick-up assembly 1730) translates with respect to gantry 1720 opposite the Z direction. In alternative embodiments, web transfer assembly 1710 includes any suitable additional or alternative structure that enables web transfer section 1700 to function as described herein.

In the example embodiment, servomechanisms 1711 and 1712 are matched and geared electronically to facilitate operation at identical rotational speed, acceleration, and deceleration. For purposes of this disclosure, the operation of servomechanisms 1711 and 1712 at substantially identical speeds includes operation of servomechanisms 1711 and 1712 with a slight variance in angular speed, acceleration, and/or deceleration to facilitate slightly curvilinear motion of pick-up assembly 1730 relative to frame 1002 to, for example, facilitate a smooth transition from Y-direction translation to Z-direction translation, and vice versa, of pick-up assembly 1730 relative to frame 1002.

A plurality of vacuum suction cups 1731 are coupled to pick-up assembly 1730. In the example embodiment, each suction cup 1731 is coupled to pick-up assembly 1730 via a respective spring 1732 having a first stiffness and configured for compression in the Z direction. In alternative embodiments, each suction cup 1731 is coupled to pick-up assembly 1730 substantially rigidly with respect to the Z direction. Each suction cup 1731 is operably coupled to a respective independent vacuum generator (not shown) for selectively providing suction to selectively attach suction cups 1731 to web 16 presented on platform 1630. In alternative embodiments, at least some suction cups 1731 are coupled to a common vacuum generator.

In the example embodiment, first compression member 1750 is coupled to pick-up assembly 1730 via at least one spring 1752. Each compression member spring 1752 is configured for compression in the Z direction. First compression member 1750 is aligned with second compression member 1270 with respect to the X direction, and is configured to be positioned opposite second compression member 1270 when pick-up assembly 1730 is positioned proximate second end 1704. Moreover, first compression member 1750 is configured to compress at least a portion of coupling region 29 of web 16 against blank 10 positioned on deck 1250 when pick-up assembly 1730 deposits web 16, to facilitate bonding web 16 to blank 10. In some embodiments, each compression member spring 1752 has a second stiffness that is greater than the first stiffness of suction cup springs 1732, to facilitate application of greater force by first compression member 1750 on web 16 and blank 10, relative to a force applied by suction cups 1731 on web 16 and blank 10. In alternative embodiments, each compression member spring 1752 and suction cup spring 1732 has any suitable stiffness that enables pick-up assembly 1730 to function as described herein.

In alternative embodiments, pick-up assembly 1730 does not include first compression member 1750. For example, adhesive is applied to at least a portion of coupling region 29 of web 16, web 16 is positioned in the at least partially overlying relationship with blank 10, and coupling region of web 16 and blank 10 are securely bonded together through compression of coupling region 29 against blank 10 during a process of wrapping blank assembly 130 about mandrel 1312.

Also in the example embodiment, pick-up assembly 1730 includes a respective sensor 1740 disposed at opposing (with respect to the Y direction) ends of pick-up assembly 1730 to verify that web 16 is successfully picked up and coupled to suction cups 1731 as gantry 1720 is moved from proximate first end 1702 to proximate second end 1704. For example, each sensor 1740 is a photo eye operable to detect a presence or absence of web 16 directly beneath pick-up assembly 1730. For example, as a speed of transfer of webs 16 by transfer mechanism 1710 is increased to facilitate increasing output of containers 200 by machine 1000, a potential for an occasional premature de-coupling of web 16 from pick-up assembly 1730 may arise. Sensors 1740 facilitate detecting this condition and diverting a resulting container formed without web 16 from product loading section 1500 (shown in FIG. 7). In alternative embodiments, machine 1000 includes suitable additional or alternative mechanisms for detecting premature de-coupling of web 16 from pick-up assembly 1730.

In some embodiments, a round trip cycle by web transfer assembly 1710, from picking up web 16 from deck 1250 proximate first end 1702, to depositing web 16 at deck 1250 proximate second end 1704, and back again to proximate first end 1702, is approximately 1 second or less. In alternative embodiments, the round trip transit time is greater than approximately 1 second but less than 5 seconds.

With reference to FIGS. 8 and 11, in the example embodiment, a web adhesive applicator 1280 is fixedly coupled to frame 1002 proximate an interface between web transfer section 1700 and transfer section 1200. More specifically, web adhesive applicator 1280 is located in at least one of web transfer section 1700 and transfer section 1200, and is offset upstream, with respect to the X direction, from leading edge 126 of blank 10 by approximately the predetermined offset distance $d_1$ (shown in FIG. 3) when blank 10 is positioned on deck 1250. In alternative embodiments, web adhesive applicator 1280 is associated with and/or positioned with respect to frame 1002 in any suitable fashion that enables web adhesive applicator 1280 to function as described herein.

In the example embodiment, web adhesive applicator 1280 is operable to eject an adhesive material upwardly, generally parallel to the Z direction, as web 16 is translated above web adhesive applicator 1280 along the Y direction by web transfer assembly 1710, such that the adhesive is applied to at least a portion of coupling region 29 of bottom surface 27 of web 16. For example, the timing of operation of web adhesive applicator 1280 is controllable by control system 1004. In alternative embodiments, adhesive is applied to coupling region 29, and/or to a portion of interior surface 12 of blank 10 complementary to coupling region 29, from any suitable direction in any suitable fashion.

With reference to FIGS. 1-3 and 7-11, in operation, web separator 1600 cuts web 16 from roll 18 of web material and positions web 16 on platform 1630. Servomechanisms 1711 and 1712 are controlled, commanded, and/or instructed to rotate simultaneously in the clockwise direction (in the view of FIG. 11) to translate gantry 1720 opposite the Y direction to proximate first end 1702 of web transfer assembly 1710. With gantry 1720 proximate first end 1702, first servomechanism 1711 is controlled, commanded, and/or instructed to rotate in the counterclockwise direction and second servomechanism 1712 is controlled, commanded, and/or instructed to rotate simultaneously in the clockwise direction to translate lift arm 1724 opposite the Z direction, such that pick-up assembly 1730 is positioned in close proximity to web 16 positioned on platform 1630. Suction cups 1731 are controlled, commanded, and/or instructed to activate, coupling web 16 to pick-up assembly 1730. First servomechanism 1711 is controlled, commanded, and/or instructed to rotate in the clockwise direction and second servomechanism 1712 is controlled, commanded, and/or instructed to rotate simultaneously in the counterclockwise direction (in the view of FIG. 11) to translate lift arm 1724 in the Z direction, such that pick-up assembly 1730 lifts web 16 off of platform 1630.

Further in operation, servomechanisms 1711 and 1712 are controlled, commanded, and/or instructed to rotate simultaneously in the counterclockwise direction (in the view of FIG. 11) to translate gantry 1720 in the Y direction to carry web 16 towards second end 1704 of web transfer assembly 1710. In certain embodiments, as gantry 1720 is translated towards second end 1704, sensors 1740 transmit a signal to control system 1004 to indicate whether web 16 remains coupled to pick-up assembly 1730. Moreover, as gantry 1720 is translated towards second end 1704, web 16 passes over web adhesive applicator 1280. Web adhesive applicator 1280 is controlled, commanded, and/or instructed to apply adhesive to at least a portion of coupling region 29 of bottom surface 27 of web 16 as web 16 passes applicator 1280.

In the example embodiment, as gantry 1720 arrives proximate second end 1704, servomechanisms 1711 and 1712 are controlled, commanded, and/or instructed to position gantry 1720 with respect to the Y direction such that first free edge 21 of web 16 is offset from first free edge 56 of blank 10 by the second predetermined offset distance $d_2$. In alternative embodiments, machine 1000 includes any suitable additional or alternative structure that facilitates positioning web 16 with respect to blank 10 with respect to the Y direction. Also in the example embodiment, bottom free edge 19 of web 16 is offset from leading edge 126 of blank 10 with respect to the X direction by the first predetermined offset distance $d_1$ due to the pre-adjustment of spool receiver 1610 of web separator 1600, as described above. In alternative embodiments, machine 1000 includes any suitable additional or alternative structure that facilitates positioning web 16 with respect to blank 10 with respect to the X direction.

With gantry 1720 proximate second end 1704, first servomechanism 1711 is controlled, commanded, and/or instructed to rotate in the counterclockwise direction and second servomechanism 1712 is controlled, commanded, and/or instructed to rotate simultaneously in the clockwise direction to translate lift arm 1724 opposite the Z direction, such that pick-up assembly 1730 positions web 16 in close proximity to blank 10 positioned on deck 1250. In certain embodiments, pick-up assembly 1730 is moved opposite the Z direction to an extent such that first compression member 1750 exerts a force opposite the Z direction on at least a portion of coupling region 29 of web 16 and the adjacent overlying portion of blank 10. Moreover, in some such embodiments, the at least one actuator 1274 is controlled, commanded, and/or instructed to translate second compression member 1270 in the Z direction to the first position, such that compression surface 1272 is positioned to provide a compression surface against which first compression member 1750 compresses coupling region 29 of web 16 and blank 10. Suction cups 1731 are controlled, commanded, and/or instructed to deactivate, releasing web 16 from pick-up assembly 1730.

Further in operation, first servomechanism 1711 is controlled, commanded, and/or instructed to rotate in the clockwise direction and second servomechanism 1712 is controlled, commanded, and/or instructed to rotate simultaneously in the counterclockwise direction (in the view of FIG. 11) to translate lift arm 1724 in the Z direction, to provide clearance between pick-up assembly 1730 and deck 1250 (and, subsequently, between pick-up assembly 1730 and platform 1630). After the desired clearance is obtained, servomechanisms 1711 and 1712 are controlled, commanded, and/or instructed to rotate simultaneously in the clockwise direction (in the view of FIG. 11) to translate gantry 1720 opposite the Y direction to proximate first end 1702 of web transfer assembly 1710 to retrieve another web 16.

Still further in operation, actuator 1266 is controlled, commanded, and/or instructed to translate pusher bar 1262 in the X direction from the first position, in which pusher feet 1264 are positioned at least slightly upstream from trailing edge 128 of blank 10 of blank assembly 130 positioned on deck 1250, to the second position, such that blank assembly 130 is positioned under a mandrel for forming container 200, as will be described herein. Actuator 1266 is then controlled, commanded, and/or instructed to translate pusher bar 1262 opposite the X direction back to the first position to enable deck 1250 to receive another blank 10. In certain embodiments, prior to translation of pusher bar 1262 in the X direction, the at least one actuator 1274 is controlled, commanded, and/or instructed to translate second compression member 1270 opposite the Z direction to the second position, in which second compression member 1270 is positioned out of a path travelled by forwarding assembly 1260 as it transfers the formed blank assembly 130 to mandrel wrap section 1300.

Figure 12:
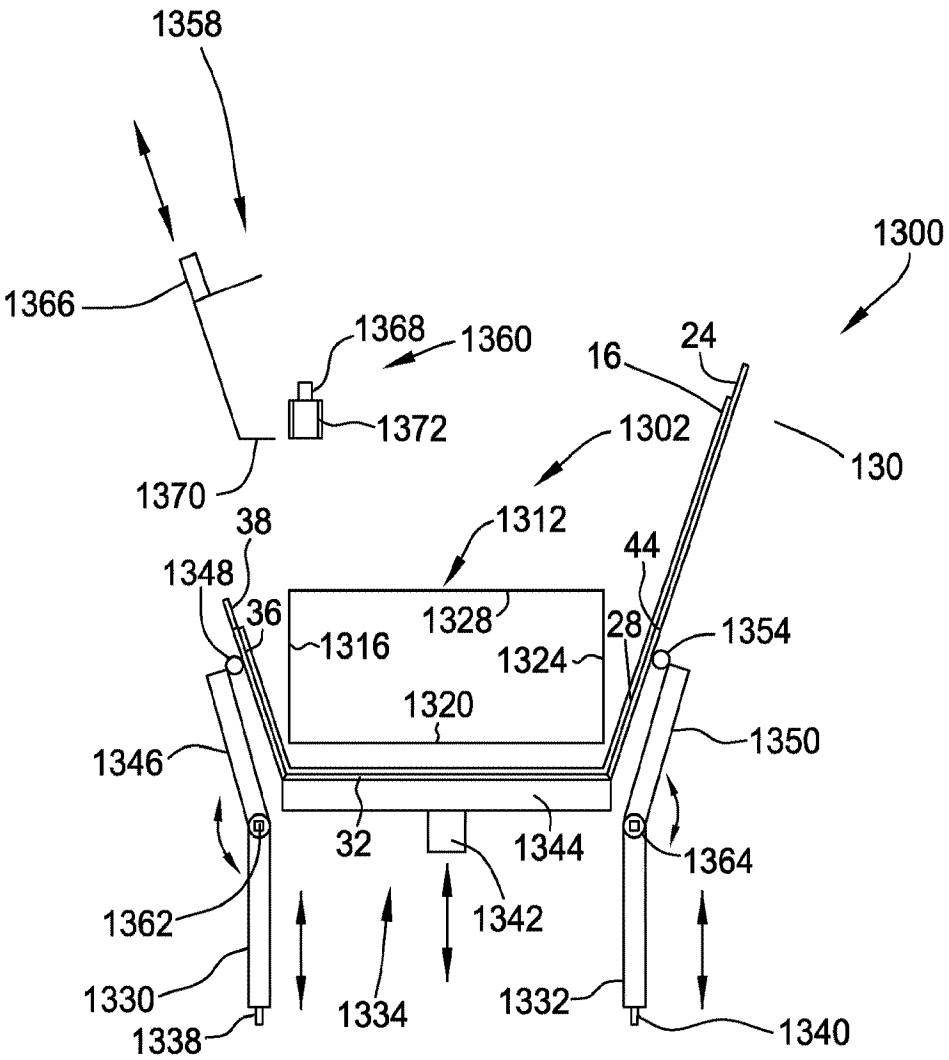
FIG. 12 is a schematic view of the example blank assembly shown in FIG. 3 received in an example mandrel wrap section included with the machine shown in FIG. 7.

FIG. 12 is a schematic illustration of mandrel wrapping section 1300, viewed upstream opposite the X direction. Mandrel wrapping section 1300 includes a mandrel assembly 1302, a lift assembly 1304, and a folding assembly 1306.

With reference to FIGS. 1-7 and 12, mandrel assembly 1302 includes a mandrel 1312 mounted to frame 1002 and having a plurality of faces. In the example embodiment, mandrel 1312 includes a first side face 1316, a bottom face 1320, a second side face 1324, and a top face 1328. First side face 1316, bottom face 1320, second side face 1324, and top face 1328 are shaped to correspond to the respective shapes of front end panel 36, second side panel 32, rear end panel 28, and first side panel 24, respectively, of blank 10. Thus, an external shape of mandrel 1312 is complementary to an internal shape of at least a portion of container 200. Any of the mandrel faces can be solid plates, frames, plates including openings defined therein, and/or any other suitable component that provides a face and/or surface configured to enable a container to be formed from a blank as described herein.

In the example embodiment, lift assembly 1304 includes a first lift mechanism 1330, a second lift mechanism 1332, and a plate assembly 1334. In certain embodiments, one or more of first lift mechanism 1330, second lift mechanism 1332, and plate assembly 1334 are coupled to a lifting frame (not shown), which is coupled to frame 1002. In the example embodiment, first lift mechanism 1330 includes an actuator 1338, second lift mechanism 1332 includes an actuator 1340, and plate assembly 1334 includes an actuator 1342. For example, each actuator 1338, 1340, and 1342 includes at least one of a hydraulic jack, an air cylinder, a mechanical linkage, a servomechanism, and another suitable mechanical or electronic actuator. In alternative embodiments, at least two of first lift mechanism 1330, second lift mechanism 1332, and plate assembly 1334 are coupled to at least one common actuator mechanism. Actuators 1338, 1340, and/or 1342 each are configured to move blank assembly 130 toward and/or against mandrel assembly 1302. As such, lift assembly 1304 is positioned adjacent mandrel assembly 1302. Plate assembly 1334 includes a plate 1344 configured to move blank assembly 130 towards mandrel 1312. Lift mechanisms 1330 and 1332 assist folding assembly 1306 in wrapping blank assembly 130 about mandrel 1312, as described in more detail below.

Folding assembly 1306 includes a lateral presser arm 1346 having an engaging bar 1348; a folding arm 1350 having an engaging bar 1354; a glue panel folder assembly 1358; a glue panel presser assembly 1360; and respective actuators 1362, 1364, 1366, and 1368. For example, each actuator 1362, 1364, 1366, and 1368 includes at least one of a hydraulic jack, an air cylinder, a mechanical linkage, a servomechanism, and another suitable mechanical or electronic actuator. In alternative embodiments, at least two of lateral presser arm 1346, folding arm 1350, glue panel folder assembly 1358, and glue panel presser assembly 1360 are coupled to at least one common actuator mechanism. Mandrel wrapping section 1300 also includes devices such as, but not limited to, guide rails and mechanical fingers (not shown).

In the example embodiment, lateral presser arm 1346 is coupled to first lift mechanism 1330 at actuator 1362, and is positionable generally proximate a first side of mandrel 1312 defined by mandrel first side face 1316. Folding arm 1350 is coupled to second lift mechanism 1332 at actuator 1364, and is positionable generally proximate both an opposite second side of mandrel 1312 defined by mandrel second side face 1324, and a top side of mandrel 1312 defined by mandrel top face 1328. In alternative embodiments, folding arm 1350 is positionable generally at least proximate the opposite second side of mandrel 1312.

Glue panel folder assembly 1358 is positioned adjacent an intersection of mandrel first side face 1316 and mandrel top face 1328. Glue panel folder assembly 1358 includes a plate 1370 and actuator 1366. In the example embodiment, actuator 1366 is configured to move glue panel folder plate 1370 toward and away from mandrel first side face 1316 in a generally linear motion. Alternatively or additionally, actuator 1366 is configured to move glue panel folder plate 1370 toward and away from mandrel first side face 1316 in a rotational motion.

Glue panel presser assembly 1360 also is positioned adjacent an intersection of mandrel first side face 1316 and mandrel top face 1328. Glue panel presser assembly 1360 includes a presser bar 1372 coupled to actuator 1368 that controls movement of presser bar 1372 toward and away from mandrel top face 1328. Presser bar 1372 is configured to compress first side panel 28 against glue panel 38 to form a manufacturer's joint of container 200, as will be described in more detail below.

In the example embodiment, mandrel wrapping section 1300 is configured such that second side panel 32 of blank assembly 130 is received adjacent to plate 1344 for lifting against bottom face 1320 of mandrel 1312. Similarly, front end panel 36 is received adjacent to engaging bar 1348 of lateral presser arm 1346, and rear end panel 28 is received adjacent to engaging bar 1354 of folding arm 1350. In alternative embodiments, mandrel wrapping section 1300 is configured to receive any suitable panel of blank assembly 130 for moving against any suitable mandrel face. Lateral presser arm 1346 and/or first lift mechanism 1330 are configured to wrap a first portion of blank assembly 130 about mandrel 1312, and folding arm 1350 and/or second lift mechanism 1332 are configured to wrap a second portion of blank assembly 130 about mandrel 1312, as is described in more detail below.

Web 16 is interposed between panels 24, 28, 32, and 36 and respective mandrel faces 1328, 1324, 1320, and 1316, however, web 16 is relatively flexible and is non-adhering with respect to mandrel assembly 1302, such that web 16 does not substantially interfere with the described wrapping of blank assembly 130 about mandrel 1312. For example, web 16 is coated with a cohesive material that adheres only to itself, and, thus, does not adhere to any portion of mandrel assembly 1302. Moreover, in certain embodiments, wrapping blank assembly 130 about mandrel 312, as described herein, further secures coupling region 29 of web 16 to blank 10.

In operation, in the example embodiment, lateral presser arm engaging bar 1348 is configured to contact second end panel 36 and/or glue panel 38 and fold panels 36 and/or 38 about mandrel 1312 as lateral presser arm 1346 is rotated by actuator 1362 and/or lifted by first lift mechanism 1330 and actuator 1338. Folding arm engaging bar 1354 is configured to contact first end panel 28 and/or first side panel 24 to wrap blank assembly 130 about mandrel 1312 as folding arm 1350 is rotated by actuator 1364 and/or lifted by second lift mechanism 1332 and actuator 1340.

Plate 1370 of glue panel folder assembly 1358 is configured to contact and/or fold glue panel 38 during formation of container 200. In the example embodiment, actuator 1366 controls movement of plate 1370 to rotate glue panel 38 about fold line 54 towards and/or into contact with mandrel top face 1328. Presser bar 1372 of glue panel presser assembly 1360 includes a pressing surface substantially parallel to mandrel top face 1328. Servomechanism 1368 controls movement of presser bar 1372 toward and away from mandrel 1312. Presser bar 1372 is configured to contact and/or fold first side panel 24 and/or glue panel 38 to form container 200. More specifically, presser bar 1372 is configured to press first side panel 24 and glue panel 38 together against mandrel face 1328 to form a manufacturer's joint of container 200. In the example embodiment, because length $L_2$ of web 16 (shown in FIG. 2) is less than length $L_1$ of blank 10 (shown in FIG. 1), a portion of first side panel 24 is not covered by web 16, facilitating direct contact between interior surface 12 of first side panel 24 and exterior surface 14 of glue panel 38 at the manufacturer's joint.

In alternative embodiments, glue panel folder assembly 1358 is configured to rotate glue panel 38 towards and/or into contact with any suitable mandrel face, and glue panel presser assembly 1360 is configured to press glue panel 38 together with any suitable panel of blank 10 against the suitable mandrel face. For one example, in some embodiments (not shown), glue panel 38 extends from first side panel 24, glue panel folder assembly 1358 is configured to rotate glue panel 38 towards and/or into contact with second end panel 36 against mandrel face 1316, and presser bar 1372 is configured to press glue panel 38 and second end panel together against mandrel face 1316 to form a manufacturer's joint of container 200. In some such embodiments, length $L_2$ of web 16 (shown in FIG. 2) is less than length $L_1$ of blank 10 (shown in FIG. 1), such that the alternative glue panel 38 extending from first side panel 24 is not covered by web 16, facilitating direct contact between interior surface 12 of glue panel 38 and exterior surface 14 of second end panel 36 at the manufacturer's joint.

In the example embodiment, mandrel wrapping section 1300 further includes a bottom folder assembly (not shown) configured to fold bottom end panels 102 and 96 about fold lines 106 and 100, respectively, to fold bottom side panels 62 and 68 about fold lines 66 and 72, respectively, and to press bottom panels 62, 68, 96, and/or 102 together to form bottom wall 206 of container 200. In the example embodiment, container 200 is ejected from mandrel wrapping section 1300 in filling configuration 204. Mandrel wrapping section 1300 includes any suitable ejection mechanism for ejecting container 200 in the filling configuration from mandrel 1312.

In the example embodiment, outfeed section 1400 is configured to move containers 200 ejected from mandrel wrapping section 1300 toward product load section 1500, such as by a conveyor assembly, for example. Product load section 1500 is positioned with respect to machine 1000 in any suitable location. Alternatively, product load section 1500 is located at one or more locations remote to machine 1000. In the example embodiment, product load section 1500 is where a product is loaded into container 200 in open configuration 204, web 16 is folded upon itself around the product to form partially packed configuration 222, and top panels 60, 94, 70, and 104 are closed and sealed to form fully packed configuration 250 for shipping and/or storing the product, as described above. In alternative embodiments, product is loaded into containers 200 formed by machine 1000 in any suitable fashion.

Figure 13:
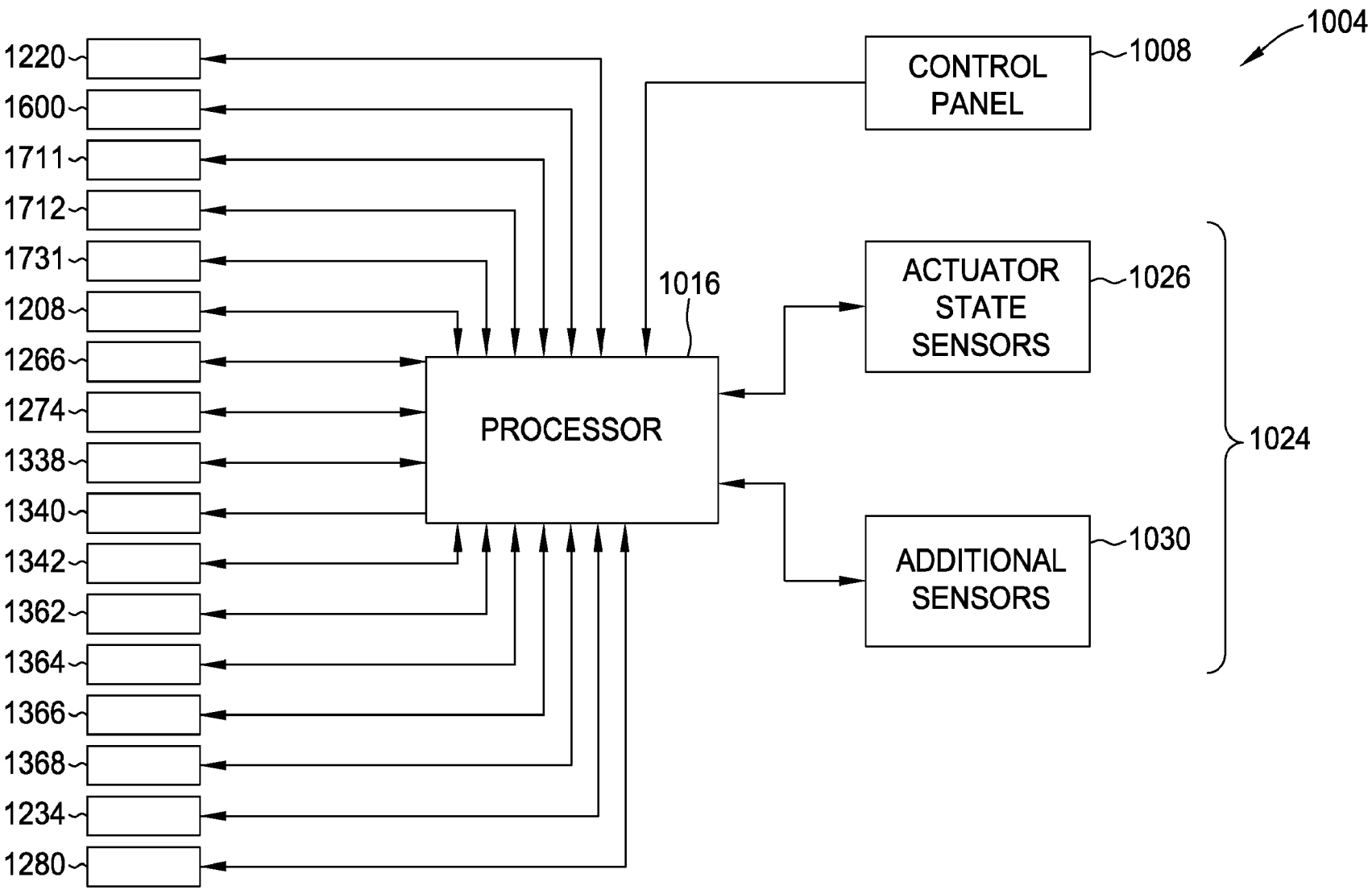
FIG. 13 is a block diagram of an example control system that may be used with the machine shown in FIG. 7.

FIG. 13 is a schematic block diagram of control system 1004. In the example embodiment, control system 1004 includes at least one control panel 1008 and at least one processor 1016. In certain embodiments, reprogrammed recipes or protocols embodied on a non-transitory computer-readable medium are programmed in and/or uploaded into processor 1016 and such recipes include, but are not limited to, predetermined speed and timing profiles, wherein each profile is associated with forming blank assemblies from blanks and webs each having a predetermined size and shape.

In the example embodiment, one or more of actuators 1208, 1266, 1274, 1338, 1340, 1342, 1362, 1364, 1366, and 1368, blank adhesive applicator 1234, web adhesive applicator 1280, web separator 1600, transfer mechanism servomechanisms 1711 and 1712, and suction cups 1220 and 1731 are integrated with machine control system 1004, such that control system 1004 is configured to transmit signals to each to control its operation. Moreover, a plurality of suitable sensors 1024 are disposed on machine 1000 and provide feedback to control system 1004 to enable machine 1000 to function as described herein. For example, plurality of sensors 1024 includes a first set 1026 of sensors to monitor a state of one or more of actuators 1208, 1266, 1274, 1338, 1340, 1342, 1362, 1364, 1366, and 1368, blank adhesive applicator 1234, web adhesive applicator 1280, web separator 1600, transfer mechanism servomechanisms 1711 and 1712, and suction cups 1220 and 1731. For example, the state includes at least a position of a respective actuator. Plurality of sensors 1024 also includes a variety of additional sensors 1030, such as but not limited to sensors 1740, suitable for enabling control system 1004 and machine 1000 to operate as described herein.

In certain embodiments, control system 1004 is configured to facilitate selecting a speed and/or timing of the movement and/or activation of the devices and/or components associated with each of actuators 1208, 1266, 1274, 1338, 1340, 1342, 1362, 1364, 1366, and 1368, blank adhesive applicator 1234, web adhesive applicator 1280, web separator 1600, transfer mechanism servomechanisms 1711 and 1712, and suction cups 1220 and 1731. The devices and/or components may be controlled either independently or as part of one or more linked mechanisms. For example, in embodiments where one or more of actuators 1208, 1266, 1274, 1338, 1340, 1342, 1362, 1364, 1366, 1368, 1711, and 1712 is a servomechanism, the speed and timing of each such actuator can be controlled independently as commanded by control system 1004.

In certain embodiments, control panel 1008 allows an operator to select a recipe that is appropriate for a particular blank assembly and/or container. The operator typically does not have sufficient access rights/capabilities to alter the recipes, although select users can be given privileges to create and/or edit recipes. Each recipe is a set of computer instructions that instruct machine 1000 as to forming the blank assembly and/or container. For example, machine 1000 is instructed as to speed and timing of picking a blank from feed section 1100, desired cut length $L_2$ of web 16 by web separator 1600, speed and timing of picking a web from web separator 1600 and transferring via web transfer section 1700, speed and timing of depositing and/or compressing the web on the blank to form the blank assembly, speed and timing of transferring the blank assembly under mandrel 1312, speed and timing of lifting the blank assembly into contact with mandrel 1312, speed and timing of moving lateral presser arm 1346, speed and timing of moving folding arm 1350, and speed and timing of transferring the formed container to outfeed section 1400. In embodiments where one or more actuators is a servomechanism, control system 1004 is able to control the movement of each such actuator independently relative to any other component of machine 1000. This enables an operator to maximize the number of blank assemblies and/or containers that can be formed by machine 1000, easily change the size of blank assemblies and/or containers being formed on machine 1000, and automatically change the type of blank assemblies and/or containers being formed on machine 1000 while reducing or eliminating manually adjustments of machine 1000.

The example embodiments described herein provide a blank assembly and/or container-forming machine that advantageously facilitates formation of a container having an article-retaining web coupled to an interior of the container. More specifically, the example embodiments described herein reduce or eliminate a need for additional packing material, such as packing peanuts, styrofoam popcorn, packing noodles, foam sheets, balled-up paper sheets or some other cushioning material, to be placed inside the container to prevent damage to fragile objects shipped within the container. In addition, the example embodiments described herein enable formation of such containers using a single integrated high-speed automated machine that receives both the blanks and a roll of web material, increasing a rate at which the containers may be formed and/or filled with goods.

Example embodiments of methods and a machine for forming a blank assembly and container from a blank and a retaining web are described above in detail. The methods and machine are not limited to the specific embodiments described herein, but rather, components of systems and/or steps of the methods may be utilized independently and separately from other components and/or steps described herein. For example, the machine may also be used in combination with other blanks and containers, and is not limited to practice with only the blank and container described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for forming a container using a machine, the container including a retaining web coupled to an interior thereof, the method comprising:

extracting a blank from a magazine;

transferring the blank in a blank transfer direction X;

positioning the blank on a deck;

translating a pick-up assembly from a first end to a second end along a horizontal direction Y perpendicular to the blank transfer direction X, said translating comprising transferring a web from a first location proximate the first end to a second location proximate the second end;

depositing, at the second location, the web into an at least partially overlying relationship with the blank positioned on the deck to form a blank assembly;

transferring the blank assembly along the deck in the blank transfer direction X while translating the pick-up assembly from the second end back to the first end; and wrapping the blank assembly around a mandrel to at least partially form the container.

2. The method of claim 1, further comprising translating the pick-up assembly in a vertical Z direction at the first location to lift the web.

3. The method of claim 2, wherein said depositing comprises translating the pick-up assembly in the vertical Z direction at the second location to lower the web.

4. The method of claim 1, further comprising compressing a coupling region of the web against the blank on the deck to further form the blank assembly.

5. The method of claim 4, wherein said compressing comprises compressing a first compression member coupling to the pick-up assembly against a second compression member coupled to a frame of the machine.

6. The method of claim 5, further comprising positioning the second compression member in a first position, in which the second compression member is positioned proximate the blank; and positioning the second compression member in a second position, in which the second compression member is positioned out of a path travelled by a forwarding assembly during said transferring the blank assembly along the deck.

7. The method of claim 1, further comprising applying an adhesive material to a portion of the web during said translating, as the web is transferred from the first location to the second location.

8. The method of claim 1, wherein the blank includes a plurality of side panels, a plurality of bottom panels, and a fold line extending between the plurality of side panels and the plurality of bottom panels, the method further comprising positioning, during said depositing, the web relative to the blank such that a free edge of the web is proximate to the fold line and extends in a direction substantially parallel to the fold line, the web overlying at least a portion of at least four side panels of the plurality of side panels in the at least partially overlying relationship.

9. The method of claim 1, wherein said wrapping comprises:

wrapping a first portion of the blank assembly about the mandrel using a lateral presser arm generally proximate a first side of the mandrel; and wrapping a second portion of the blank assembly about the mandrel using a folding arm generally proximate a second side of the mandrel.

10. A method for forming a blank assembly using a machine, the blank assembly including a blank and a retaining web coupled to the blank, the method comprising:

placing the blank in a first position on a deck;

translating a pick-up assembly from a first end to a second end along a direction Y, said translating comprising transferring a web from a first location proximate the first end to a second location proximate the second end;

depositing, at the second location, the web into an at least partially overlying relationship with the blank positioned on the deck to form a blank assembly;

compressing the web against the blank on the deck, using a first compression member coupled to the pick-up assembly via at least one spring;

transferring the blank assembly along the deck in the blank transfer direction X while translating the pick-up assembly from the second end back to the first end; and wrapping the blank assembly around a mandrel to at least partially form the container.

11. The method of claim 10, wherein said depositing comprises positioning the web in the at least partially overlying relationship in which a first offset distance is defined between a first transverse edge of the web and a leading transverse longitudinal edge of the blank.

12. The method of claim 11, wherein said compressing comprises compressing the first compression member against a second compression member coupled to a frame of the machine, wherein a downstream edge of the first compression member is offset upstream, with respect to a blank transfer direction X, by the first offset distance from the leading edge of the blank.

13. The method of claim 12, further comprising positioning the second compression member in a first position, in which the second compression member is positioned proximate the blank; and positioning the second compression member in a second position, in which the second compression member is positioned out of a path travelled by a forwarding assembly during while transferring the blank assembly along the deck in the blank transfer direction X after said compressing.

14. The method of claim 10, wherein positioning the blank on the deck comprises moving the blank in a blank transfer direction X parallel to the deck, the blank transfer direction being perpendicular to the Y direction.

15. The method of claim 10, further comprising translating the pick-up assembly in a vertical Z direction at the first location to lift the web from a platform spaced from the deck.

16. The method of claim 10, further comprising applying an adhesive material to a portion of the web during said translating, as the web is transferred from the first location to the second location.

17. The method of claim 10, wherein the blank includes a plurality of side panels, a plurality of bottom panels, and a fold line extending between the plurality of side panels and the plurality of bottom panels, the method further comprising positioning, during said depositing, the web relative to the blank such that a free edge of the web is proximate to the fold line and extends in a direction substantially parallel to the fold line, the web overlying at least a portion of at least four side panels of the plurality of side panels in the at least partially overlying relationship.

18. The method of claim 10, further comprising, prior to said placing the blank on the deck:

extracting the blank from a magazine; and transferring the blank in a blank transfer direction X towards the deck.

* * * * *